US009575504B2

(12) United States Patent
Dize et al.

(10) Patent No.: US 9,575,504 B2
(45) Date of Patent: Feb. 21, 2017

(54) HIGH DEGREE OF FREEDOM (DOF) CONTROLLER

(71) Applicants: Chad Alan Dize, Arlington, VA (US); Daniel R. Wahl, Chicago, IL (US); Thomas W. Van Doren, Fredericksburg, VA (US)

(72) Inventors: Chad Alan Dize, Arlington, VA (US); Daniel R. Wahl, Chicago, IL (US); Thomas W. Van Doren, Fredericksburg, VA (US)

(73) Assignee: HDT Expeditionary Systems, Inc., Solon, OH (US)

( * ) Notice: Subject to any disclaimer, the term of this patent is extended or adjusted under 35 U.S.C. 154(b) by 289 days.

(21) Appl. No.: 14/247,602

(22) Filed: Apr. 8, 2014

(65) Prior Publication Data

US 2014/0216192 A1 Aug. 7, 2014

Related U.S. Application Data

(63) Continuation-in-part of application No. 13/045,665, filed on Mar. 11, 2011, now Pat. No. 8,881,616.

(60) Provisional application No. 61/860,546, filed on Jul. 31, 2013, provisional application No. 61/312,700, filed on Mar. 11, 2010.

(51) Int. Cl.
*G05G 11/00* (2006.01)
*G05G 9/047* (2006.01)

(52) U.S. Cl.
CPC ..... *G05G 9/04788* (2013.01); *G05G 9/047* (2013.01); *Y10T 74/20201* (2015.01)

(58) Field of Classification Search
CPC ..... G05G 9/047; G05G 9/04788
See application file for complete search history.

(56) References Cited

U.S. PATENT DOCUMENTS 3,028,126 A 4/1962 Holleman
4,216,467 A 8/1980 Colston
(Continued)

FOREIGN PATENT DOCUMENTS

GB 2 264 771 A1 9/1993
WO WO 95/13576 5/1995

OTHER PUBLICATIONS

International Search Report of International Application No. PCT/US2011/028040, dated Jul. 11, 2011.
(Continued)

*Primary Examiner* — David M Fenstermacher
(74) *Attorney, Agent, or Firm* — Fay Sharpe LLP

(57) ABSTRACT

Disclosed is a high degree of freedom control apparatus that includes a base attached to a strain gauge assembly movable in three orthogonal directions to provide signals indicative of a position of the strain gauge assembly relative to the base. An actuator assembly is supported on the base and movable by an operator's arm, hand, digit, or wrist relative to the base structure. The actuator assembly provides signals indicative of the position of the operator's arm, hand, digit or wrist in at least seven degrees of freedom relative to the base structure. The actuator assembly includes a wrist angle stage and a digit angle stage. The strain gauge assembly includes a spring plate and a load cell that is configured to provide a signal indicative of deflection of the load cell relative to the base.

20 Claims, 38 Drawing Sheets

(56) References Cited

U.S. PATENT DOCUMENTS

| | | | | |
|---|---|---|---|---|
| 4,658,233 | A * | 4/1987 | Uchida | G01L 1/2262 338/2 |
| 4,895,039 | A | 1/1990 | Hegg | |
| 4,914,976 | A | 4/1990 | Wyllie | |
| 5,107,080 | A | 4/1992 | Rosen | |
| 5,503,040 | A | 4/1996 | Wright | |
| 5,854,622 | A | 12/1998 | Brannon | |
| 6,360,615 | B1 * | 3/2002 | Smela | A61B 5/1124 73/862.474 |
| 6,698,952 | B1 | 3/2004 | Goddard | |
| 6,893,320 | B2 | 5/2005 | Caiozza | |
| 7,138,981 | B2 | 11/2006 | Kim et al. | |
| 7,151,527 | B2 | 12/2006 | Culver | |
| 7,204,168 | B2 | 4/2007 | Najafi et al. | |
| 8,502,776 | B2 | 8/2013 | Kamentser et al. | |
| 2002/0175894 | A1 | 11/2002 | Grillo | |
| 2006/0156848 | A1 | 7/2006 | Gosselin et al. | |
| 2007/0089536 | A1 * | 4/2007 | Morimoto | G01L 5/161 73/862.045 |
| 2008/0193260 | A1 | 8/2008 | Yokokohji et al. | |
| 2009/0090208 | A1 | 4/2009 | Diccion | |
| 2010/0016766 | A1 | 1/2010 | Zhang et al. | |

OTHER PUBLICATIONS

Written Opinion of International Application No. PCT/US2011/028040, dated Jul. 11, 2011.

International Preliminary Report on Patentability of International Application No. PCT/US2011/028040 dated Sep. 11, 2012.

* cited by examiner

HIGH DEGREE OF FREEDOM (DOF) CONTROLLER

REFERENCE TO RELATED APPLICATIONS

This application is a continuation-in-part of U.S. patent application Ser. No. 13/045,665, filed Mar. 11, 2011, which claims priority to U.S. Provisional Patent Application No. 61/312,700 filed on Mar. 11, 2010. Additionally, this application claims priority to U.S. Provisional Patent Application No. 61/860,546 filed on Jul. 31, 2013. These applications are hereby fully incorporated by reference herein.

BACKGROUND

The present disclosure relates generally to machine control actuators and more particularly to a high degree of freedom control actuator or controller. Joysticks and other control actuators provide an interface allowing an operator to control one or more functions of a machine, such as an aircraft, robot, crane, truck, underwater unmanned vehicle, wheelchair, surveillance camera, computer, etc. Conventional joysticks include a stick member pivotally mounted to a base and include components to generate signals indicating the stick's displacement from a neutral position. In addition, joystick controllers often include one or more button or knob-type actuators allowing an operator to initiate predefined machine functions, such as firing a weapon in a video game running on a computer or gaming machine. Typical joystick actuators, however, provide only a limited number of degrees of freedom (DoF), and thus are unable to implement more complicated operator control functions.

SUMMARY

Various details of the present disclosure are hereinafter summarized to facilitate a basic understanding, where this summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter. An apparatus for controlling a machine is provided in accordance with one or more aspects of the disclosure, which has a base structure attached to a strain gauge assembly movable in three orthogonal directions to provide at least one signal or value indicative of a position of the strain gauge assembly relative to the base structure. An actuator assembly is supported on the base structure movable by at least one of an associated operator's arm, hand, digit, and wrist relative to the base structure, the actuator assembly operative to provide at least one signal or value indicative of the position of at least one of the operator's arm, hand, digit and wrist in at least six degrees of freedom relative to the base structure.

The actuator assembly includes a wrist angle stage that is moveable about at least one of three orthogonal directions relative to the base structure by operator hand, forearm or wrist motion, the wrist angle stage providing at least one signal or value indicative of the pivotal position of the wrist angle stage relative to the base member with respect to rotation about at least one of the three orthogonal directions. Further, the actuator assembly comprising a digit angle stage comprising at least one digit actuator movable by operator hand motion relative to the wrist angle stage, the digit angle stage providing at least one signal or value indicative of the position of the at least one digit actuator relative to the wrist stage with respect to at least one of a finger flexion, a thumb flexion, and a thumb rotation of the operator's hand.

In certain embodiments, a toggle switch is provided, which is operable by thumb motion and which provides a signal or value indicating an actuation state of the toggle switch.

A dead man switch is provided in certain embodiments, which is operable by finger motion relative to the digit angle stage. The digit angle stage provides at least one signal or value indicative of an actuation state of the dead man switch.

BRIEF DESCRIPTION OF THE DRAWINGS

The following description and drawings set forth certain illustrative implementations of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1A:
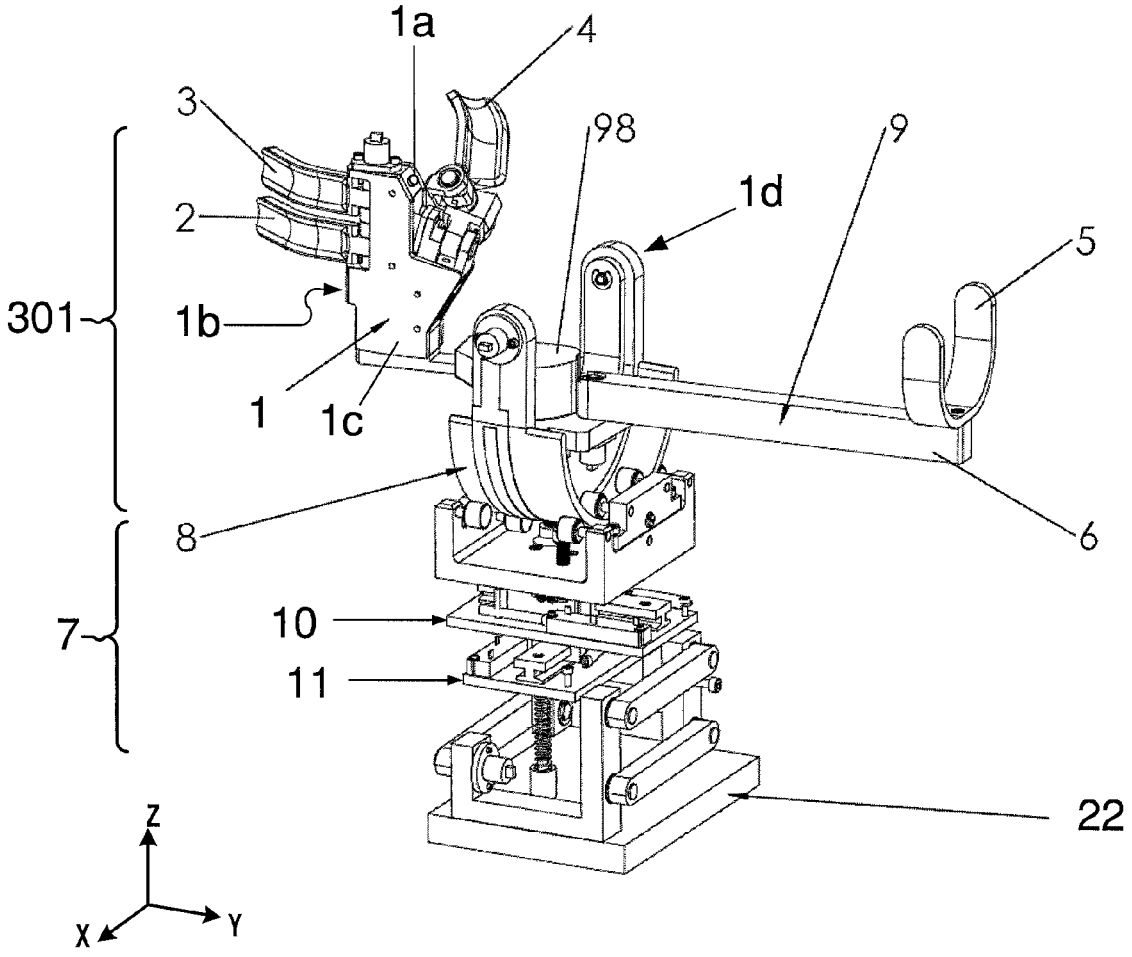
FIGS. 1A and 1B illustrate an 11 degree of freedom joystick assembly according to a first embodiment of the present disclosure.
Figure 1B:
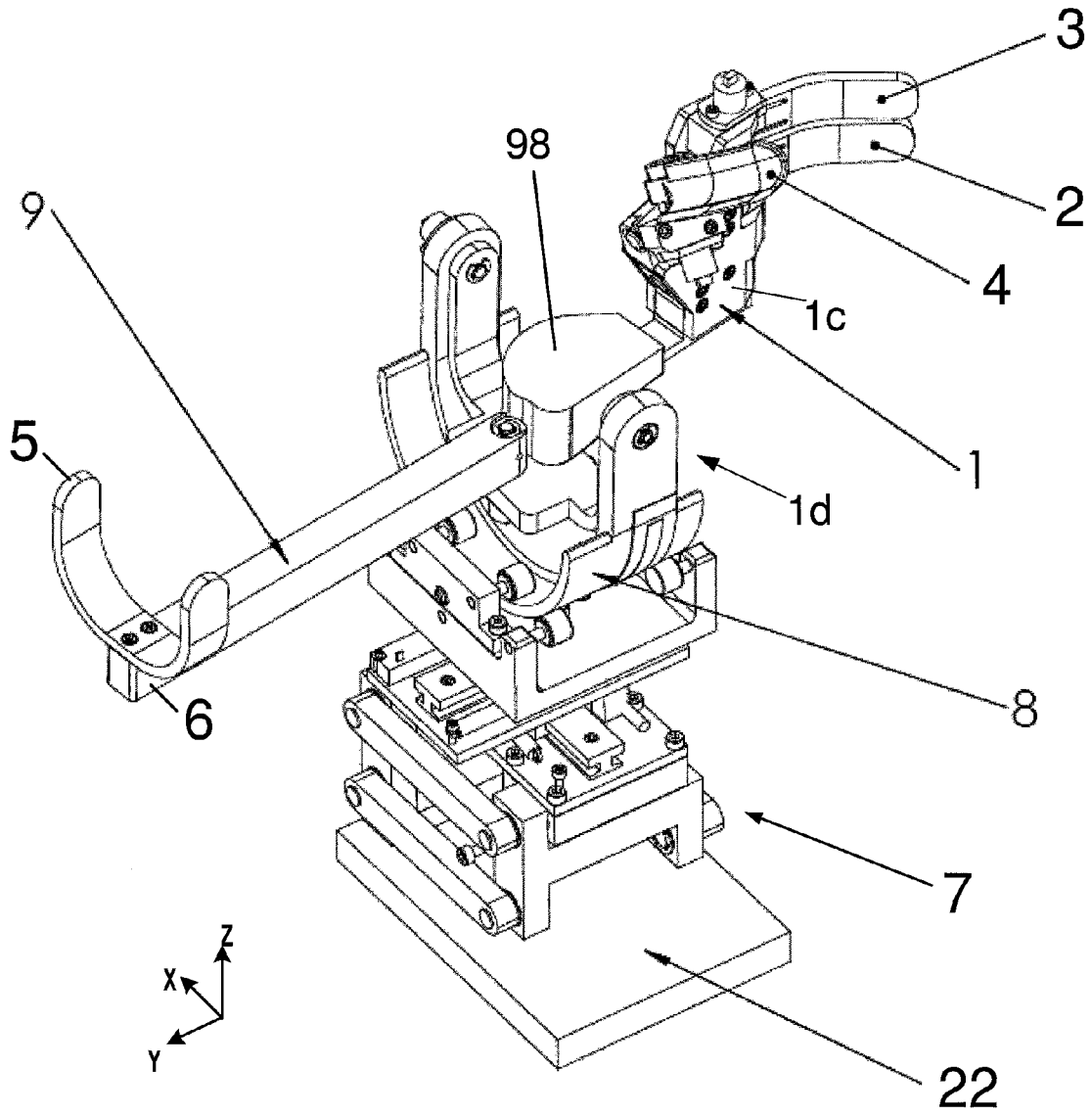

One or more embodiments or implementations are hereinafter described in conjunction with the drawings, where like reference numerals are used to refer to like elements throughout, and where the various features are not necessarily drawn to scale.

One embodiment of the high degree of freedom (DoF) control actuator apparatus or joystick is shown in FIGS. 1A through 20. As is shown in the drawings and particularly in FIG. 14, the joystick assembly comprises a digit angle stage 1, an XYZ stage 7, a wrist angle stage 8, and forearm angle stage 9.

The control actuator apparatus includes a base structure 22 to which is mounted an XYZ stage 7. The XYZ stage includes a support structure that is movable in orthogonal X, Y, and/or Z directions indicated in the figures relative to the base structure 22, and includes one or more sensors providing signals and/or values indicating the position of the support structure relative to that of the base 22 in the X. Y, and/or Z directions. The control apparatus also includes an upper actuation assembly 301 (numerically indicated in FIG. 2) supported on the XYZ stage 7. The upper actuation assembly 301 includes a wrist angle stage 8 movable relative to the XYZ stage 7 by operator hand, forearm or wrist motion, as well as a forearm angle stage 9 movable relative to the XYZ stage 7 and relative to the wrist angle stage 8 by operator forearm motion, and a digit angle stage 1 including at least one actuator 2, 3, and 4 movable by operator hand motion relative to the wrist angle stage 8.

The stages 1, 7, and 8 are provisioned with position indicating/measuring sensors of any suitable type or types to provide signals and/or values indicating the positioning of the operator's hand, wrist, and/or forearm. Suitable sensor types include without limitation potentiometers (pots), switches or switch arrays, linear-variable differential transformers (LVDTs), Hall effect sensors, electro-magnetic sensors such as proximity sensors, magnetic flux detectors, optical position sensors, or other sensors that provide one or more signals or values (analog and/or digital) indicating relative positioning (linear and/or rotational) of one or more actuator structures (tabs, members) and other structures or assemblies as described herein. The apparatus, moreover, can be coupled with any suitable form of wired and/or wireless means for providing such sensor signals and/or values to a controlled machine or other intermediate system, details of which are omitted in the figures so as not to obscure the illustrated structures.

In the illustrated embodiments, the wrist angle stage 8 includes one or more sensors that provide signals and/or values indicating the position of the wrist angle stage 8 with respect to rotation, flexion, and/or deviation. The forearm angle stage 9 is equipped with one or more sensors that provide signals and/or values indicating the position of the forearm angle stage 9 relative to the XYZ stage 7 and/or relative to the wrist angle stage 8. The digit angle stage 1 includes one or more sensors providing signals and/or values indicating the position of the actuators 2, 3, 4 relative to the digit angle stage 1 with respect to deflection of at least one of an index finger flexion, a middle finger flexion, a thumb flexion, and/or a thumb rotation of the operator's hand.

Figure 3A:
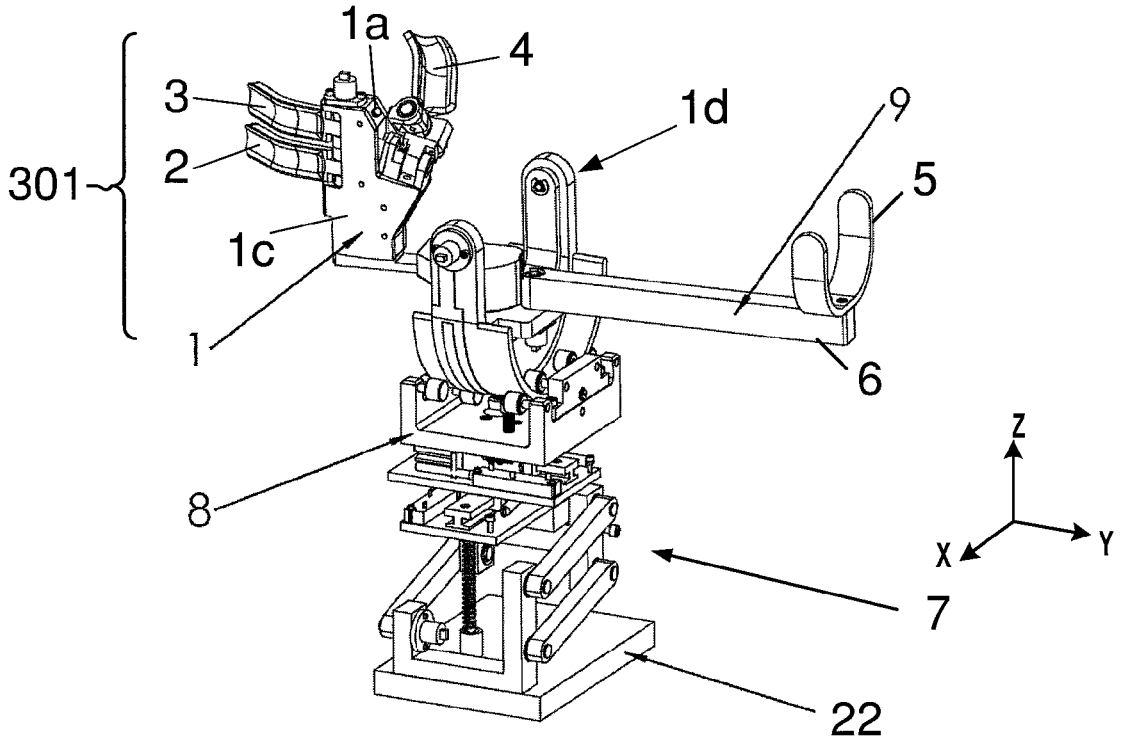
FIG. 3A illustrates an 11 degree of freedom joystick assembly with the Z degree of freedom extended to its maximum travel.
Figure 3B:
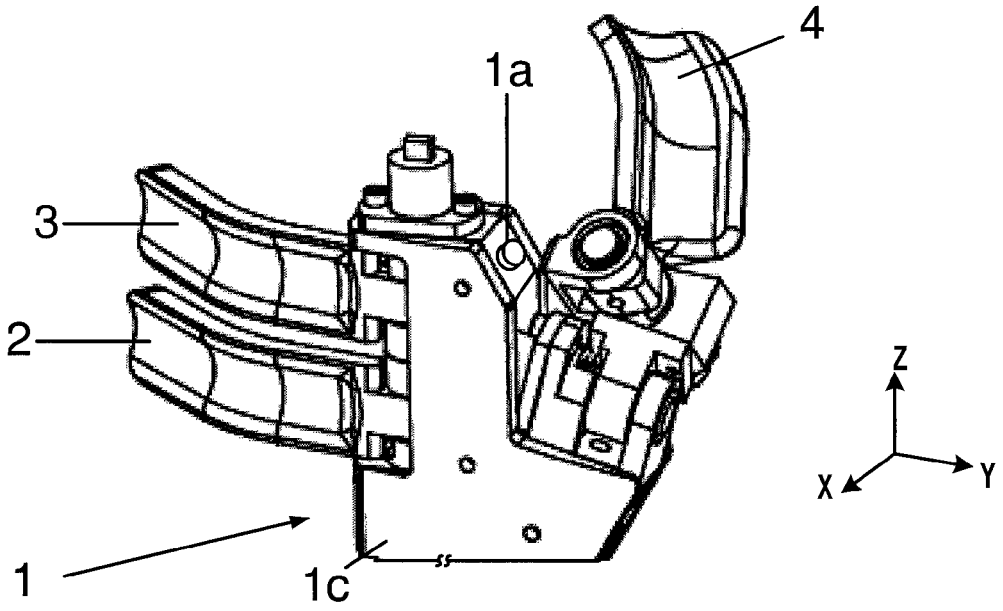
FIG. 3B illustrates a digit angle stage of the 11 degree of freedom joystick assembly with a toggle switch.

A toggle switch 1*a* is positioned toward the top rear of the digit angle stage 1 as best shown in FIG. 3B to provide the ability to change functional modes conveniently. This location is designated because its position is ergonomically advantageous, although other locations could be used. The toggle switch 1*a* is operable by thumb motion relative to the digit angle stage 1, and the digit angle stage 1 provides one or more signals or values that indicate an actuation state of the toggle switch 1*a*.

Figure 3C:
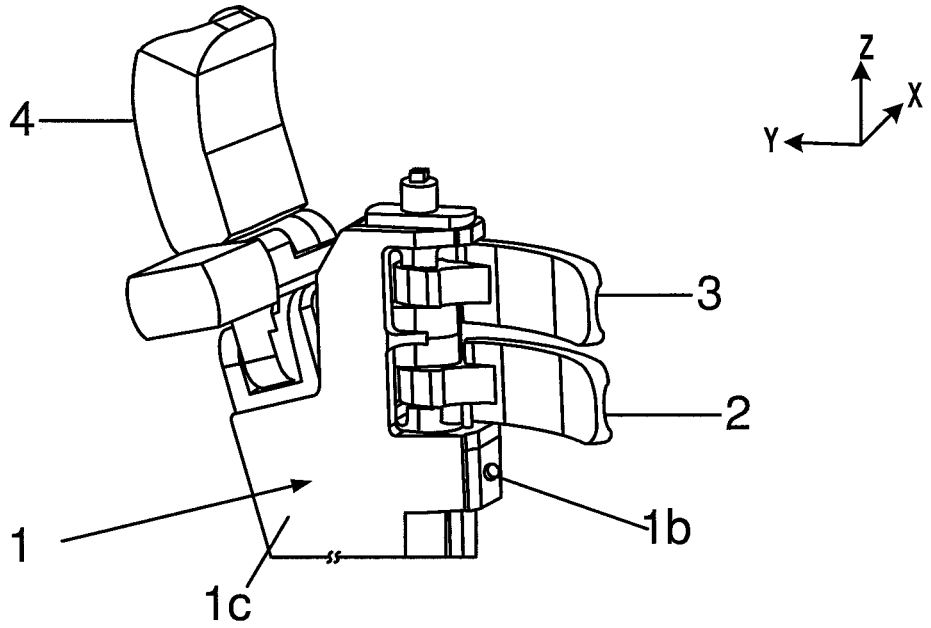
FIG. 3C illustrates the digit angle stage of the 11 degree of freedom joystick assembly with a dead man switch.

As also seen in FIG. 3C, the exemplary digit angle stage 1 also includes a dead man switch 1*b*, and the digit angle stage 1 provides one or more signals or values indicative of the actuation state of the dead man switch, for example, to inactivate control when the operator releases the joystick. This switch 1*b* in certain embodiments is located on the front of the digit stage as best shown in FIG. 3C, although other locations may be used.

In addition, certain embodiments of the disclosed control actuator apparatus include one or more force and/or torque producing components that operate to provide torque and/or force to one or more of the degree of freedom actuators. The apparatus may further comprise one or more tactile actuators and other feedback components.

Figure 2:
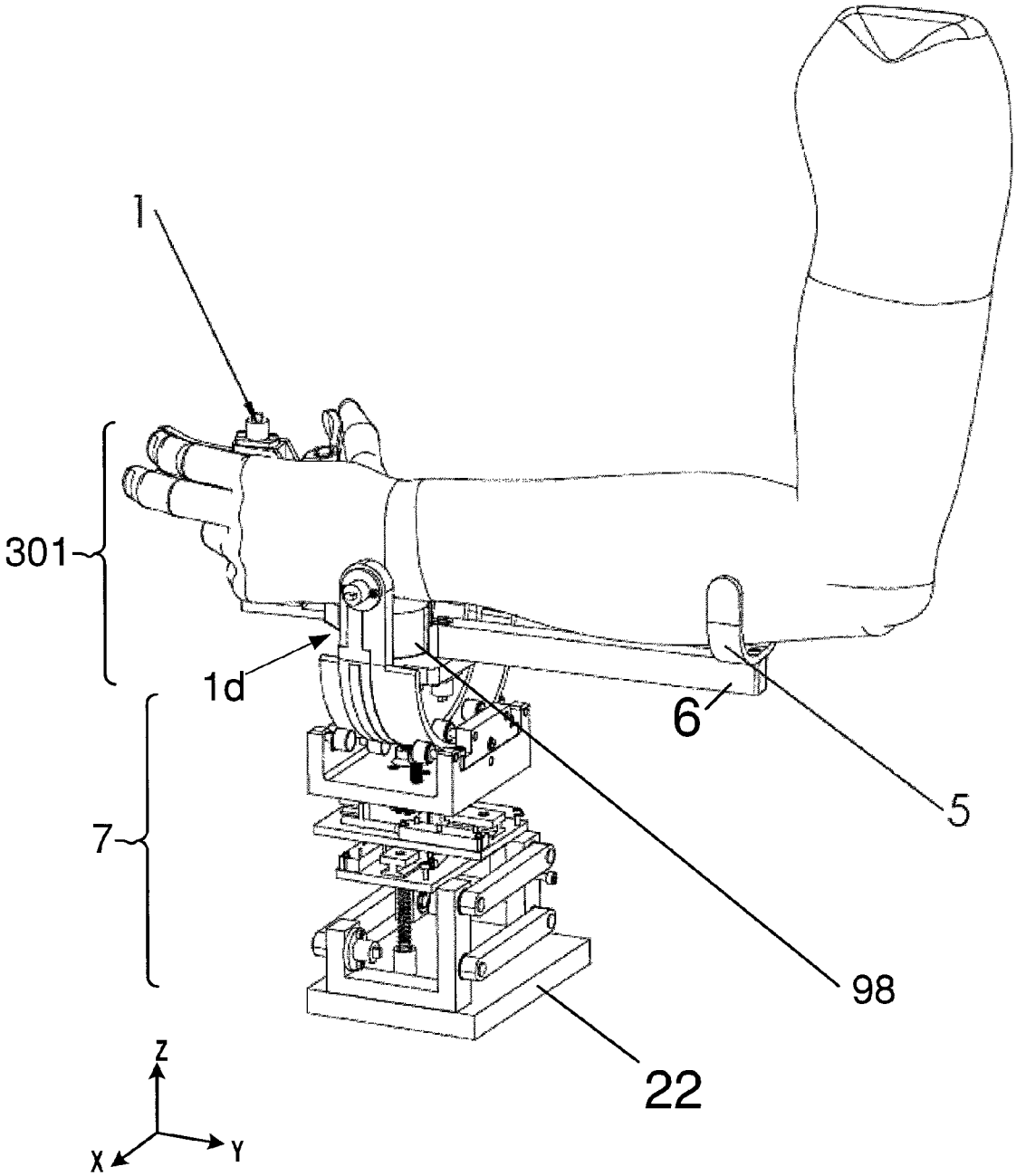
FIG. 2 illustrates an 11 degree of freedom joystick assembly with a representation of a human arm positioned to operate the joystick assembly.

As is shown in FIG. 2, the high DoF joystick is configured to allow a human arm to contact digit angle assembly 1, palm edge support 98 and forearm bracket 5. The human operator can then simultaneously control any or all of the 11 degrees of freedom demonstrated in FIGS. 3-13 using natural arm motions.

Figure 4:
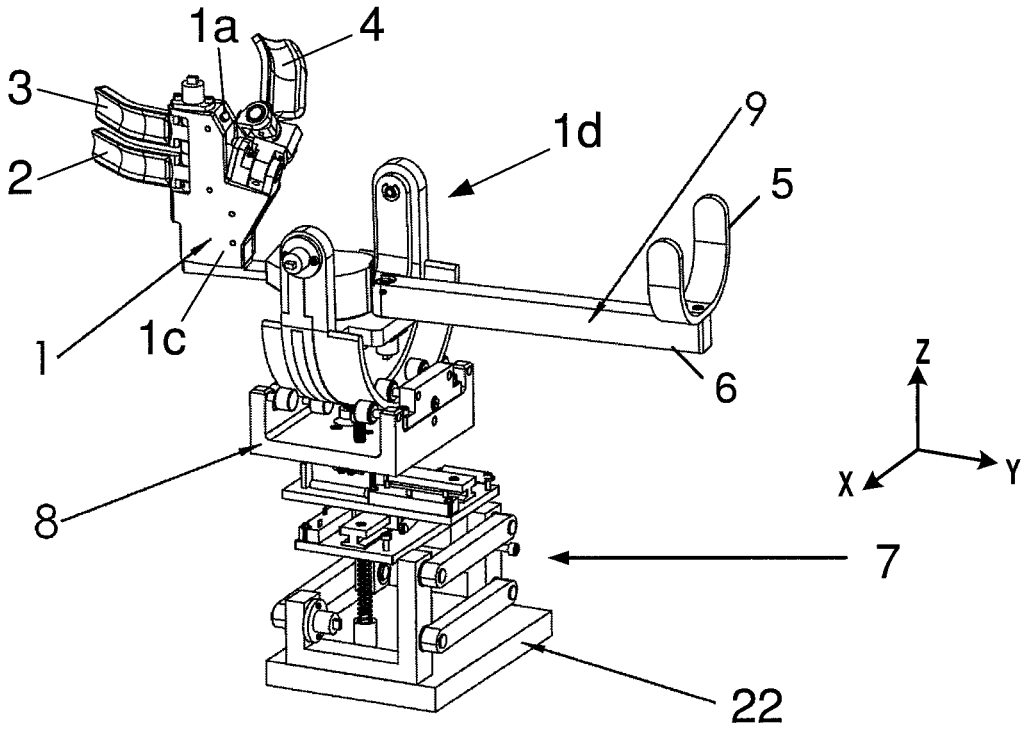
FIG. 4 illustrates an 11 degree of freedom joystick assembly with the Y degree of freedom extended to its maximum travel.
Figure 5:
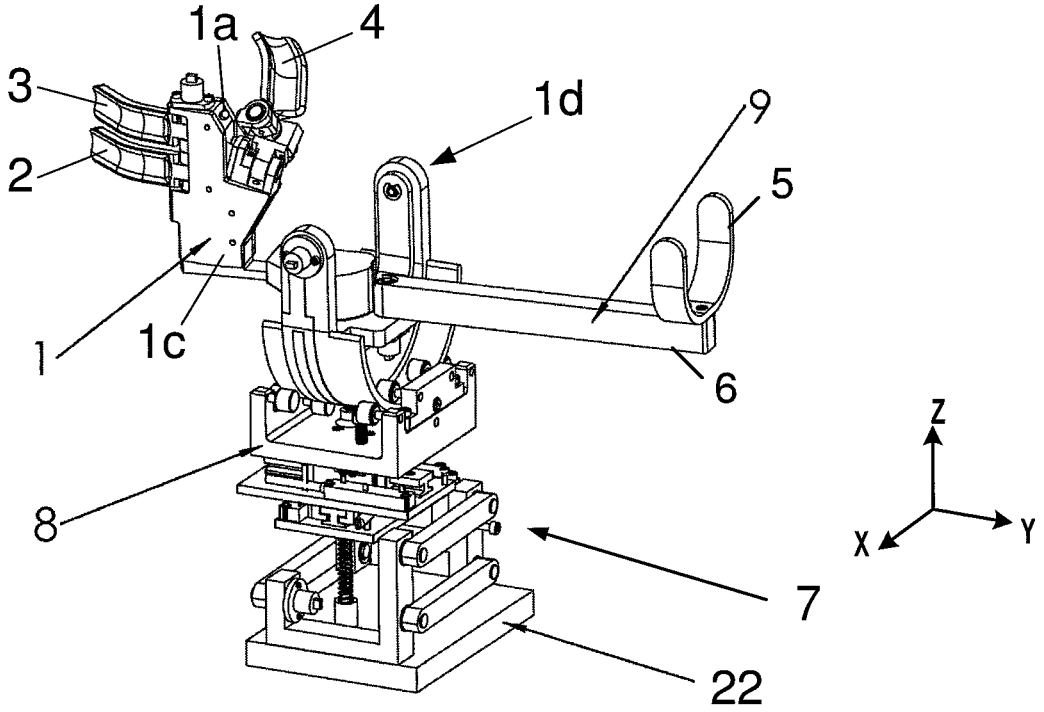
FIG. 5 illustrates an 11 degree of freedom joystick assembly with the X degree of freedom extended to its maximum travel.
Figure 15:
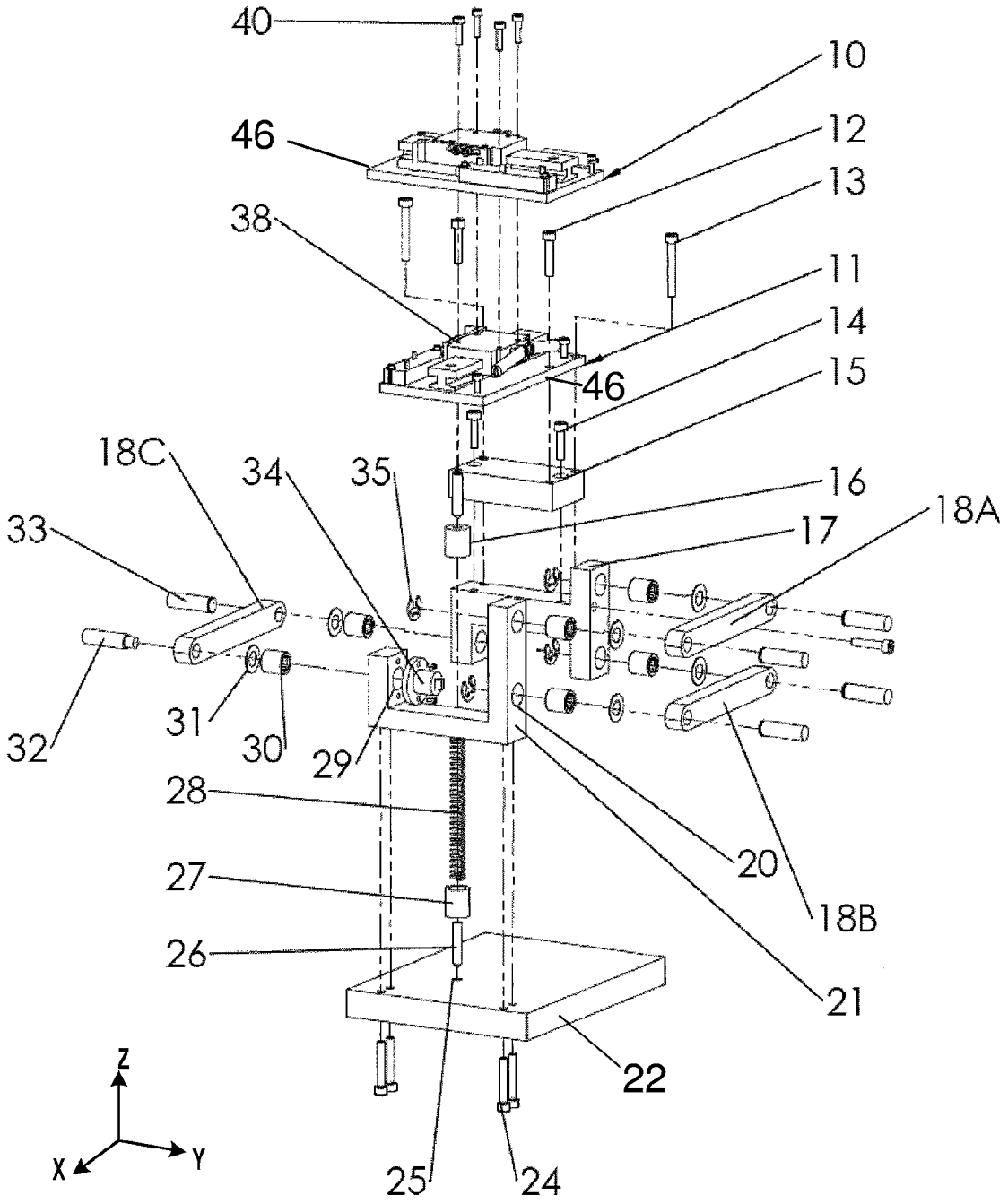
FIG. 15 illustrates an exploded view of the XYZ stage of an 11 degree of freedom joystick assembly, where the XYZ stage measures the linear travel of the X, Y, and Z degrees of freedom.

FIGS. 3A, 4, and 5 show motion of the XYZ stage 7 in the Z direction (FIG. 3A), Y direction (FIG. 4), and X direction (FIG. 5). An exploded view of XYZ stage 7 is shown in FIG. 15. XYZ stage 7 is attached to ground at base plate 22.

Motion in the Z direction is controlled by links 18A, 18B, and 18C and biasing spring 28 shown in FIG. 15. The movement of link 18C is measured by rotary potentiometer 34, is mounted to bracket 21 via hole 20 and measures the rotation of shaft 32, which in turn is pressed into link 18C and mounts to bracket 21 in rolling-element bearing 30 in holes 29. The other end of link 18C mounts via pressed-in shaft 33 to bracket 17 using a rolling-element hearing 30, a thrust washer 31, and a retaining clip 35. Links 18A and 18B similarly mount to brackets 17 and 21 using press-in shafts 33, rolling element bearings 30, thrust washers 31, and retaining clips 35. Biasing spring 28 is attached to plate 22 using cup 27 mounted on threaded stud 26, which is threaded into threaded hole 25. The top end of biasing spring 28 rests on the bottom of plate 46 of linear bearing assembly 11.

Figure 16:
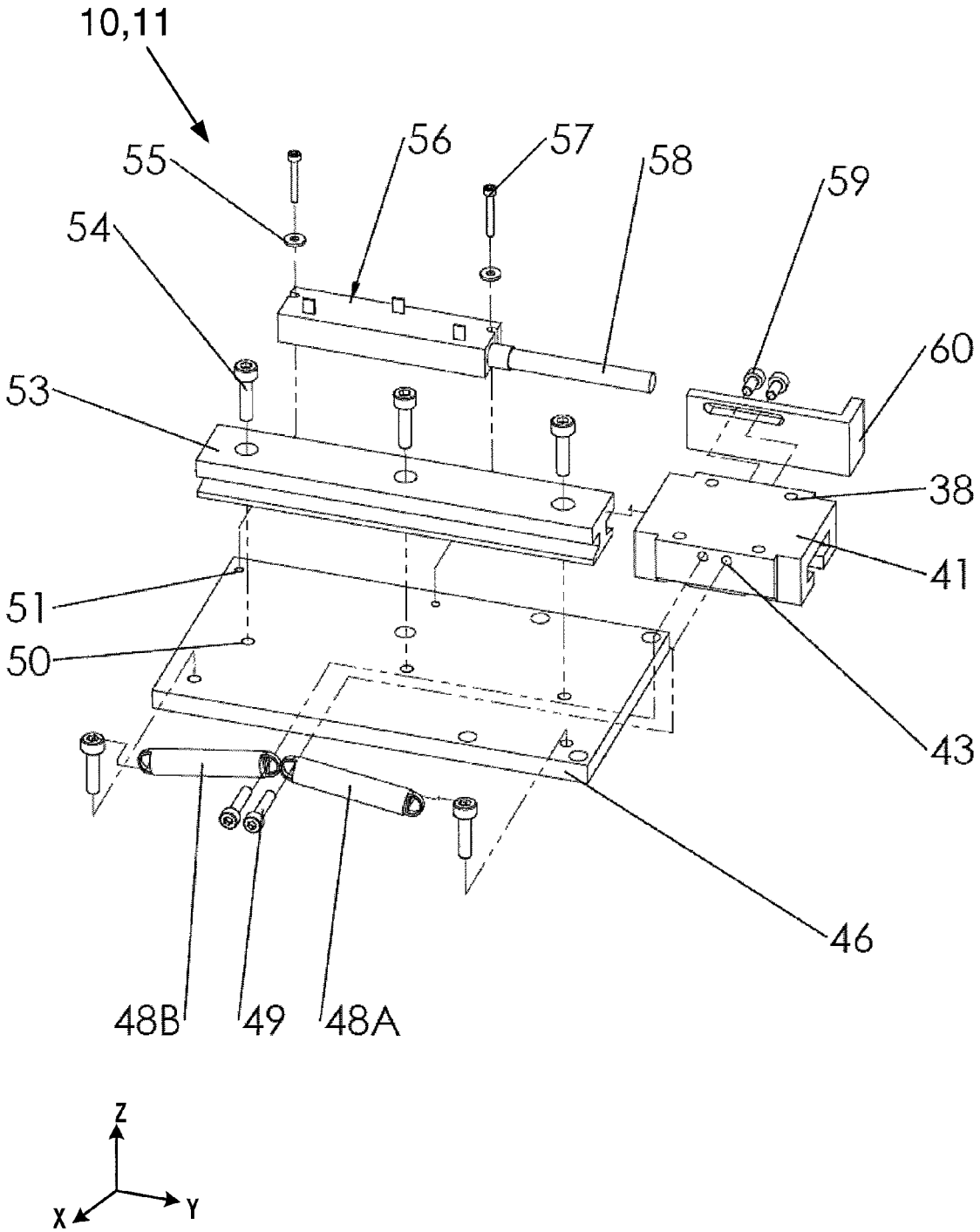
FIG. 16 illustrates an exploded view of the linear travel subassembly common to the X and Y degrees of freedom of the XYZ stage.

Motion in the X and Y directions is controlled by the linear bearing assemblies 11 and 10, respectively. An exploded view of linear bearing assembly 11 is shown in FIG. 16, and the Y direction linear bearing assembly 10 is functionally identical. Motion is controlled by linear bearing 41 moving on rail 53 and also by the centering springs 48A and 48B. The linear motion is measured by linear potentiometer assembly 56, and a spring-loaded plunger 58 acts against bracket 60. Rail 53 is mounted to a plurality of threaded holes 50 in plate 46 using a plurality of fasteners 54. Linear potentiometer assembly 56 is mounted to threaded holes 51 in plate 46 using fasteners 57 and washers 55. Bracket 60 is mounted to threaded holes 43 in linear bearing 41 using fasteners 59. Such fasteners can be screws, if desired. Centering springs 48A and 48B are mounted to fasteners 49 which are threaded into threaded holes 43 in linear bearing 41.

Linear bearing assembly 11 is attached through mounting block 15 to bracket 17 with a plurality of fasteners 12, 13, and 14. Linear bearing assembly 10 is attached to linear bearing assembly 11 with threaded fasteners 40 which are engaged with threaded holes 38 shown in FIG. 15.

Figure 6:
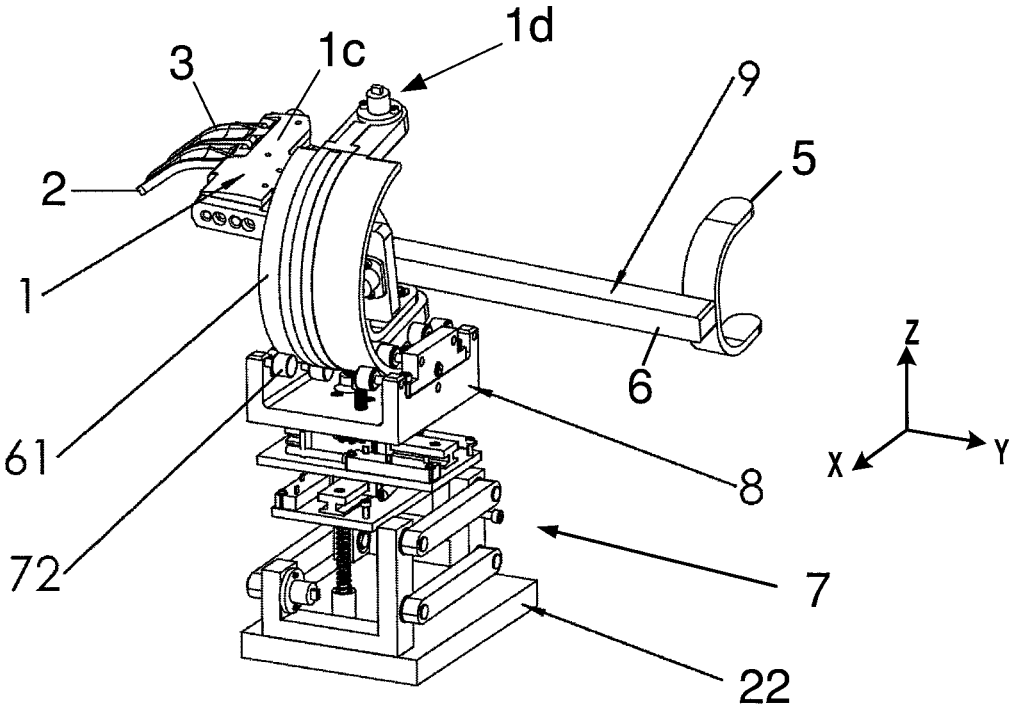
FIG. 6 illustrates an 11 degree of freedom joystick assembly with the wrist rotation degree of freedom deflected to its maximum travel.
Figure 7:
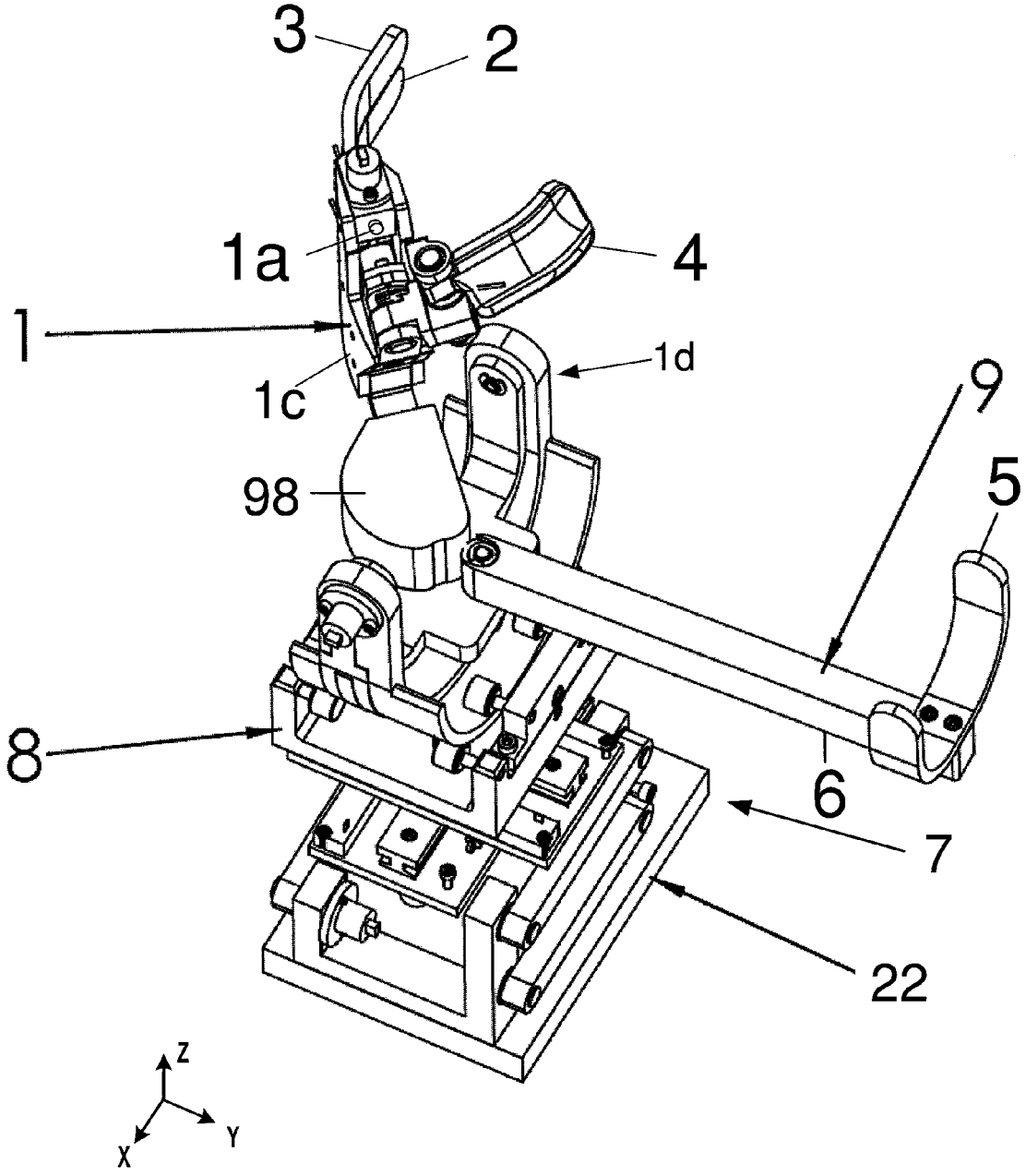
FIG. 7 illustrates an 11 degree of freedom joystick assembly with the wrist flexion degree of freedom deflected to its maximum travel.
Figure 8:
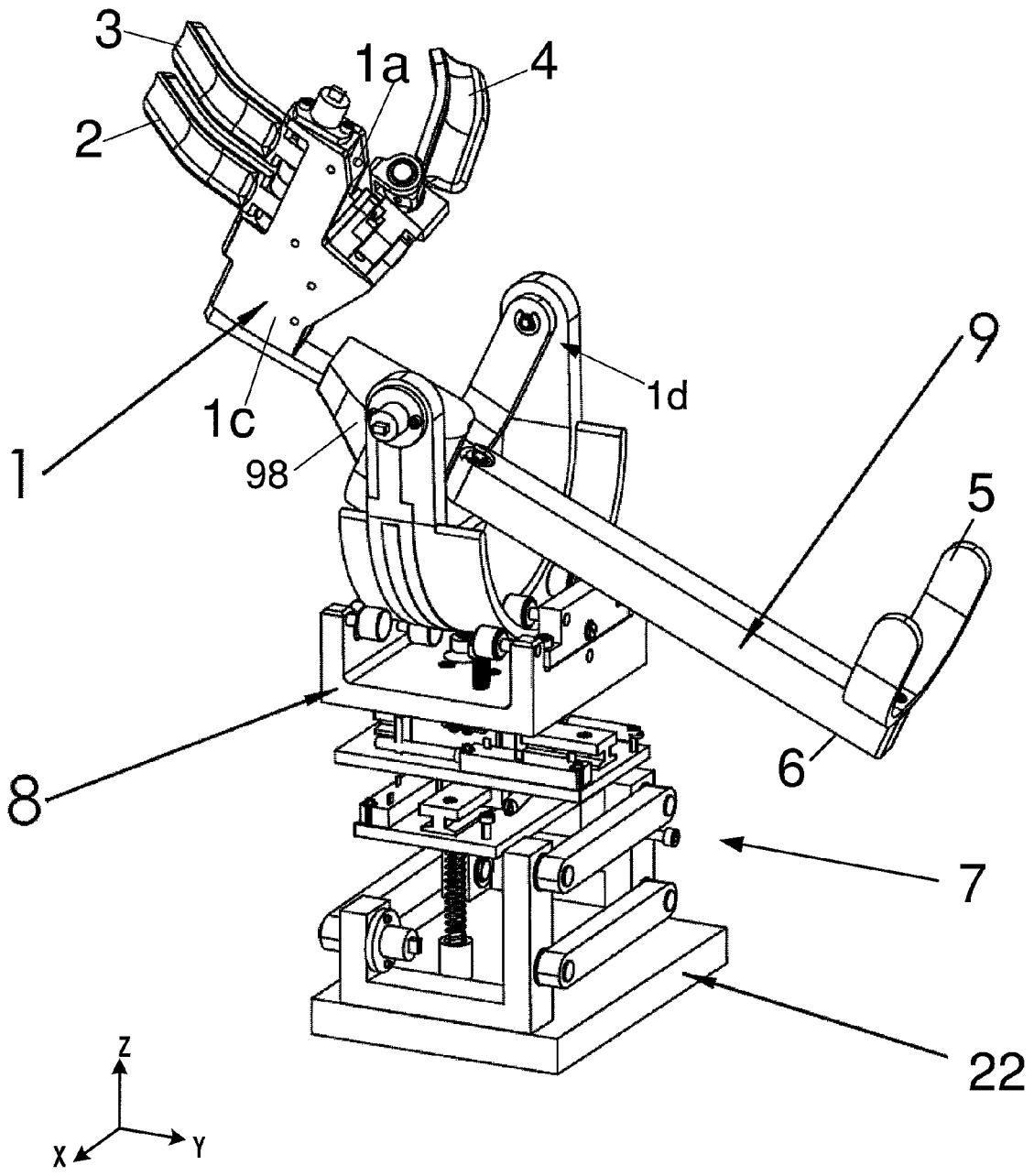
FIG. 8 illustrates an 11 degree of freedom joystick assembly with the wrist deviation degree of freedom deflected to its maximum travel.
Figure 17:
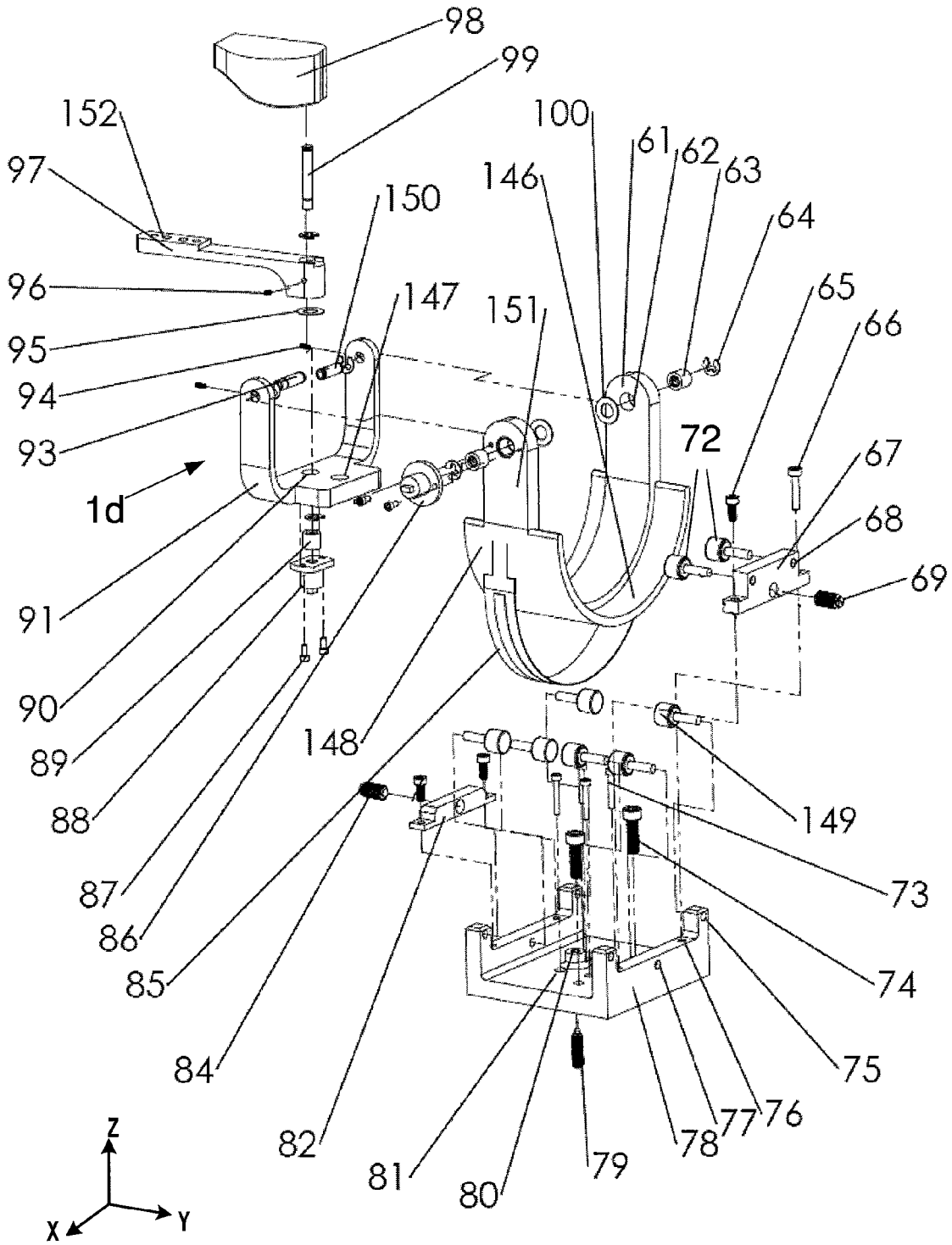
FIG. 17 illustrates an exploded view of the wrist angle stage of an 11 degree of freedom joystick assembly, where the wrist angle stage measures the deflection of the wrist rotation, flexion, and deviation degrees of freedom.

An exploded view of wrist angle stage 8 is shown in FIG. 17. FIGS. 6-8 show motion of wrist angle stage 8 in rotation about the Y axis, direction via wrist rotation yoke 61 and rollers 72 and 149 (FIGS. 6 and 17), flexion with pivotal movement of a wrist pivot actuator 1*c* about the Z direction via mounting of a palm edge 98 using dowel pin 99 in hole 90 (FIGS. 7 and 17), and deviation with pivotal movement of a wrist deviation actuator 1*d* about the X direction via a u-shaped deviation yoke 91 using shaft 99 (FIGS. 8 and 17). Wrist angle stage 8 mounts to XYZ stage 7 using a plurality of threaded fasteners 73 mounted through countersunk clearance holes and engaged with threaded holes 38 in linear bearing 41 of linear bearing assembly 11.

Wrist flexion link 97 mounts to hole 90 in deviation yoke 91 using shaft 99, two retaining clips 64, thrust washer 95 and rolling element bearing 89. Shaft 99 is fixed to wrist flexion link 97 using a set screw 96 or the like. Rotary potentiometer 88 mounts to deviation yoke 91 using fasteners 87 and measures the rotation of shaft 99 (and therefore wrist flexion link 97) relative to deviation yoke 91. Palm edge support 98 can be epoxied to wrist flexion link 97.

Wrist deviation yoke 91 mounts to holes 62 in wrist rotation yoke 61 with shafts 93 and 150, two retaining clips 64 per shaft, rolling element bearings 63, and thrust washers 100. Shafts 93 and 150 can be fixed to wrist deviation yoke 91 with set screws 94. Rotary potentiometer 86 is attached to wrist rotation yoke 61 using two fasteners 87 and measures the rotation of shaft 93 (and therefore of wrist deviation yoke 91) with respect to wrist rotation yoke 61.

Cylindrical surface 148 of wrist rotation yoke 61 rests on a plurality of bottom rollers 149 which are in turn mounted in threaded holes 75 and 77 of bottom bracket 78. Top rollers 72 mount in holes 68 of bracket 67, which in turn mounts to holes threaded holes 76 in bottom bracket 78 using fasteners 65 and 66. Top rollers 72 capture surface 146 of wrist rotation yoke 61 and allow the yoke to rotate freely about the cylindrical axis of surface 146 until either of surfaces 151 contact stop members 74, which are mounted in bottom bracket 78. Ball-nose spring plungers 69 and 84 mount to brackets 67 and 82, respectively. The spring plungers 69 and 84 contact wrist rotation yoke 61 and limit motion of the yoke along the cylindrical axis of surface 146 (the Y direction). Potentiometer 85 mounts to cylindrical surface 148. Ball-nose spring plunger 79 mounts through hole 80 in bottom bracket 78; the nose of ball-nose spring plunger 79 contacts potentiometer 85, thus allowing measurement of the angular position of wrist rotation yoke 61 with respect to bottom bracket 78.

Figure 9:
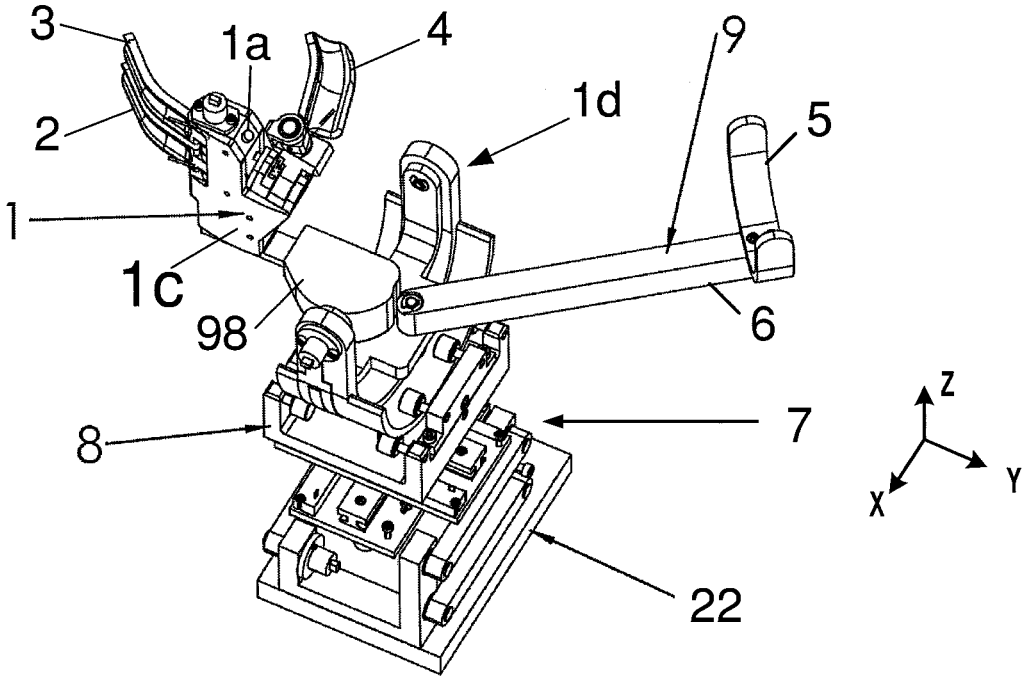
FIG. 9 illustrates an 11 degree of freedom joystick assembly with the forearm angle degree of freedom deflected to its maximum travel.
Figure 18:
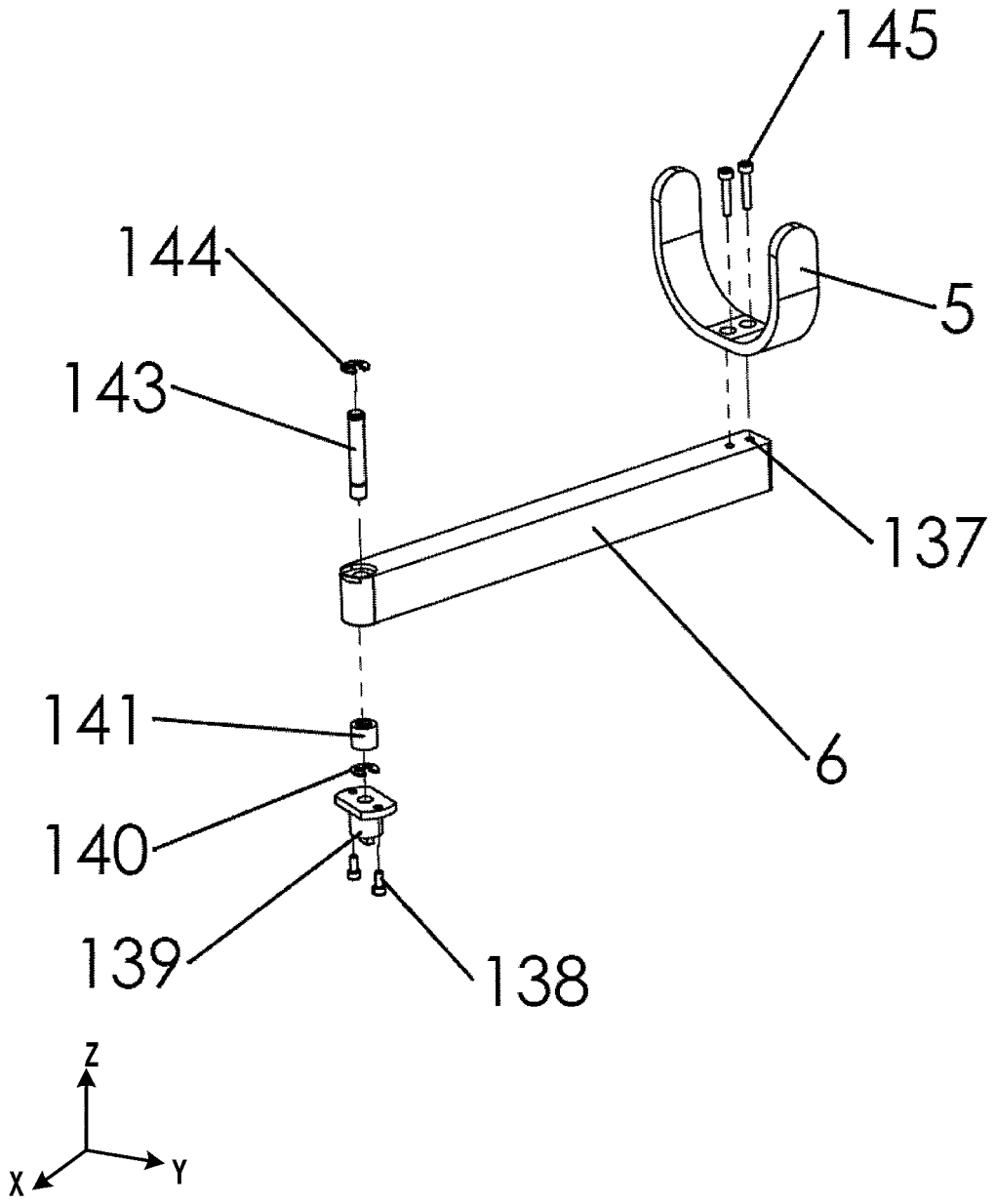
FIG. 18 illustrates an exploded view of the forearm angle stage of an 11 degree of freedom joystick assembly.

An exploded view of forearm angle stage 9 is shown in FIG. 18. FIG. 9 shows motion of forearm angle stage 9. Link 6 mounts to hole 147 in wrist deviation yoke 91 using shaft 143, retaining clips 144 and 140, and rolling-element bearing 141. Shaft 143 is fixed with respect to link 6. Rotary potentiometer 139 is attached to wrist deviation yoke 91 with fasteners 138 and measures the position of shaft 143 (and therefore link 6) with respect to wrist deviation yoke 91. Forearm support bracket 5 attaches to link 6 using threaded fasteners 145 engaging threaded holes 137.

Figure 10:
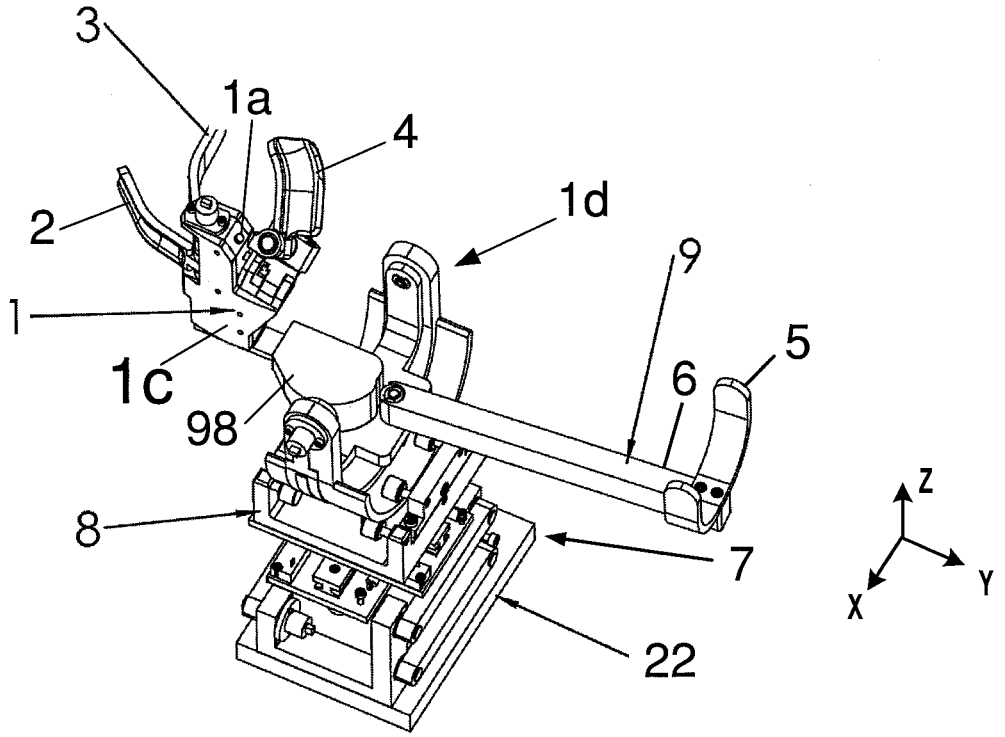
FIG. 10 illustrates an 11 degree of freedom joystick assembly with the index finger flexion degree of freedom deflected to its maximum travel.
Figure 11:
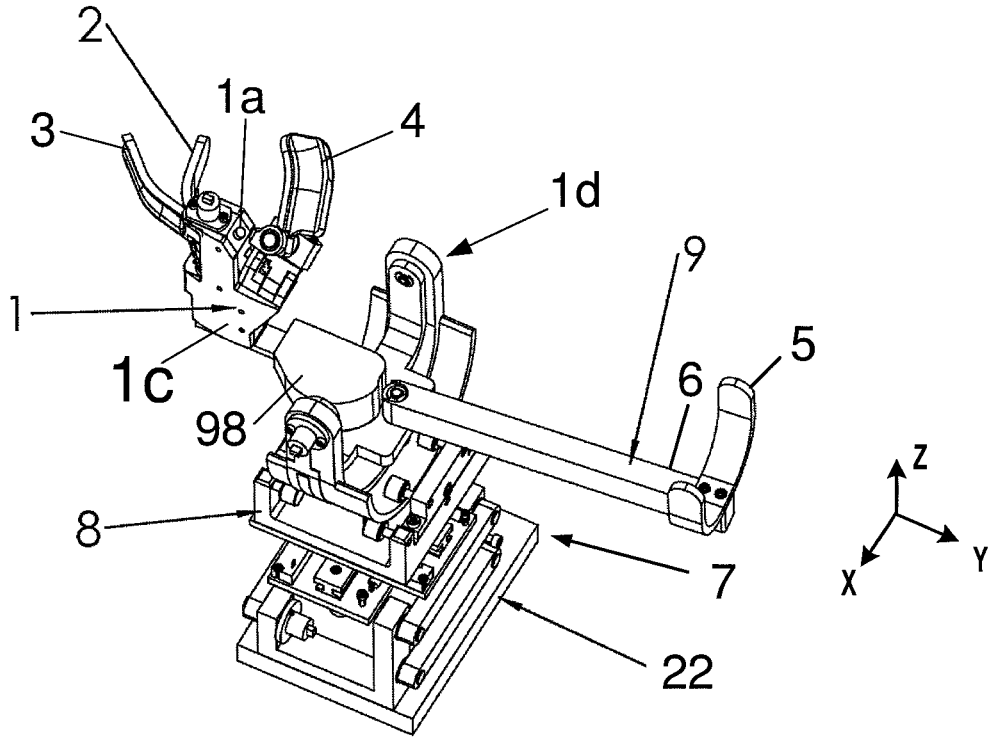
FIG. 11 illustrates an 11 degree of freedom joystick assembly with the middle finger flexion degree of freedom deflected to its maximum travel.
Figure 12:
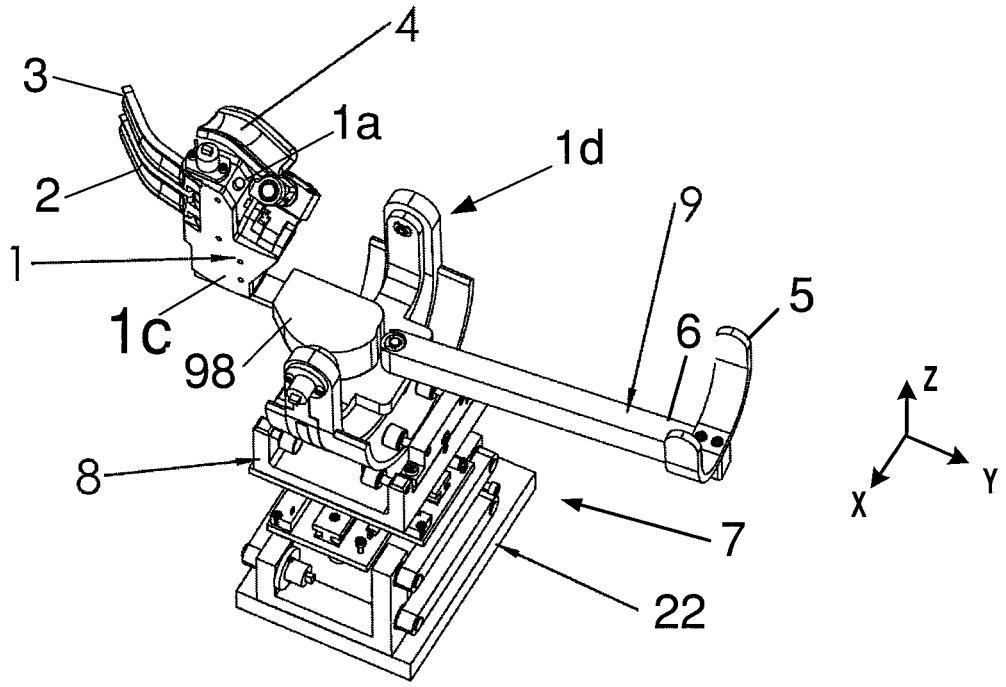
FIG. 12 illustrates an 11 degree of freedom joystick assembly with thumb flexion degree of freedom deflected to its maximum travel.
Figure 13:
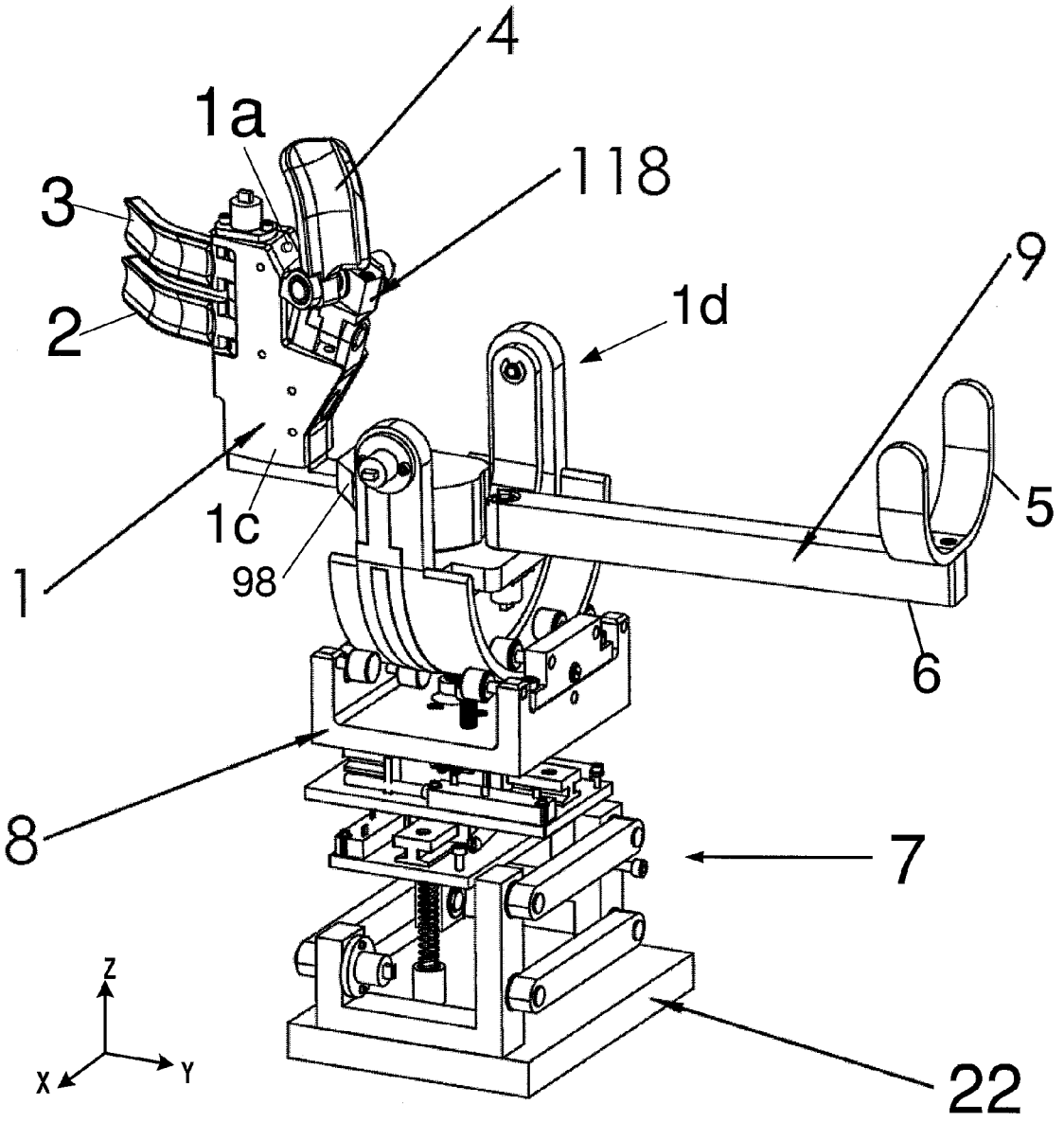
FIG. 13 illustrates an 11 degree of freedom joystick assembly with thumb rotation degree of freedom deflected to its maximum travel.
Figure 14:
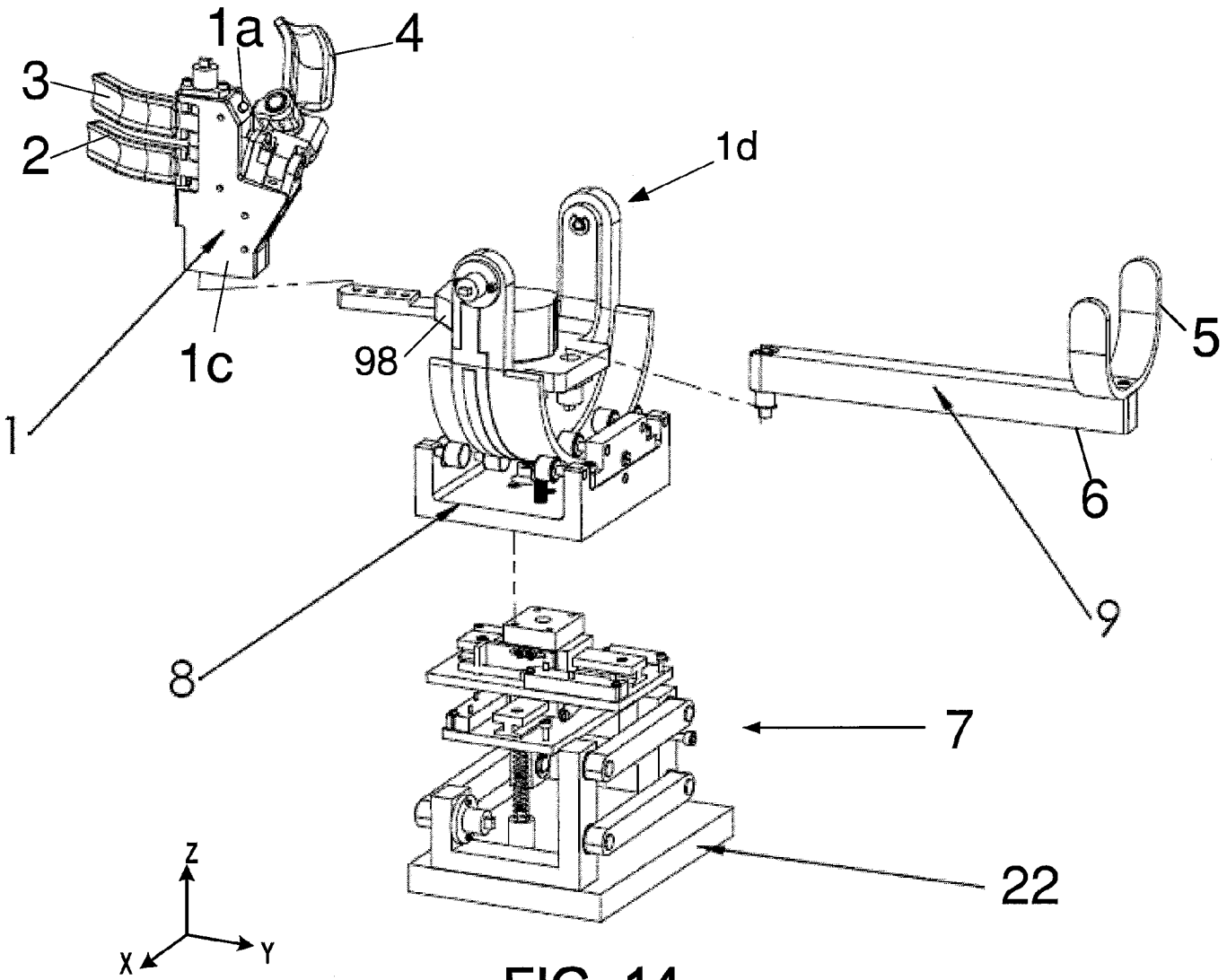
FIG. 14 illustrates an exploded view of the 4 major subassemblies of an 11 degree of freedom joystick assembly.
Figure 19:
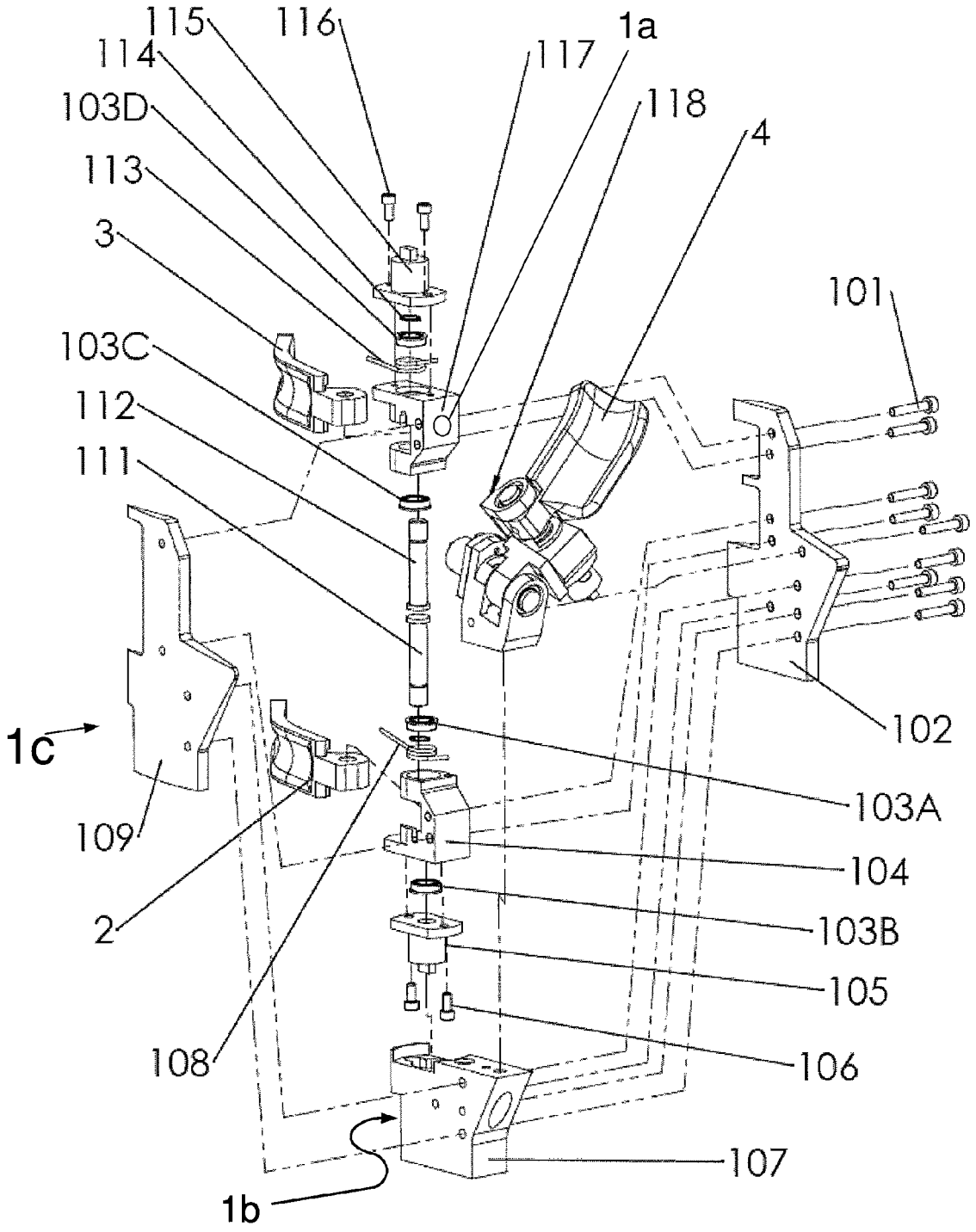
FIG. 19 illustrates an exploded view of the digit angle stage of an 11 degree of freedom joystick assembly, where the digit angle stage measures the deflection of the index finger flexion, middle finger flexion, thumb flexion, and thumb rotation degrees of freedom.

An exploded view of digit angle stage 1 is shown in FIG. 19. FIGS. 10-13 show motion of digit angle stage 1. Motion of index finger paddle 3 is shown in FIG. 10, motion of middle finger paddle 2 is shown in FIG. 11, flexion in thumb paddle 4 is shown in FIG. 12, and rotation of thumb paddle 4 is shown in FIG. 13. The digit angle stage 1 mounts to wrist flexion link 97 at holes 152. Bracket 117, bracket 104, and thumb motion subassembly 118 are joined to support plate 109, support plate 102, and bracket 107 using a plurality of fasteners 101.

Index finger paddle 3 mounts to bracket 117 with flanged shaft 112, flanged rolling-element bearings 103C and 103D, torsion return spring 113, and retaining clip 114. Shaft 112 is fixed to bracket 117 so that there is no relative motion between the two. Rotary potentiometer 115 is mounted to bracket 117 using fasteners 116 and measures the rotation of shaft 112 (and therefore index finger paddle 3) with respect to bracket 117. The toggle switch 1*a* is mounted to bracket 117.

Similarly, middle finger paddle 2 mounts to bracket 104 with flanged shaft 111, flanged rolling-element bearings 103A and 103B, torsion return spring 108, and a retaining clip 114. Shaft 111 is fixed to bracket 104 so that there is no relative motion between the two. Rotary potentiometer 105 is mounted to bracket 104 using fasteners 106 and measures the rotation of shaft 111 (and therefore middle finger paddle 2) with respect to bracket 104. The dead-man switch 1*b* is mounted on the front face of bracket 107.

Figure 20:
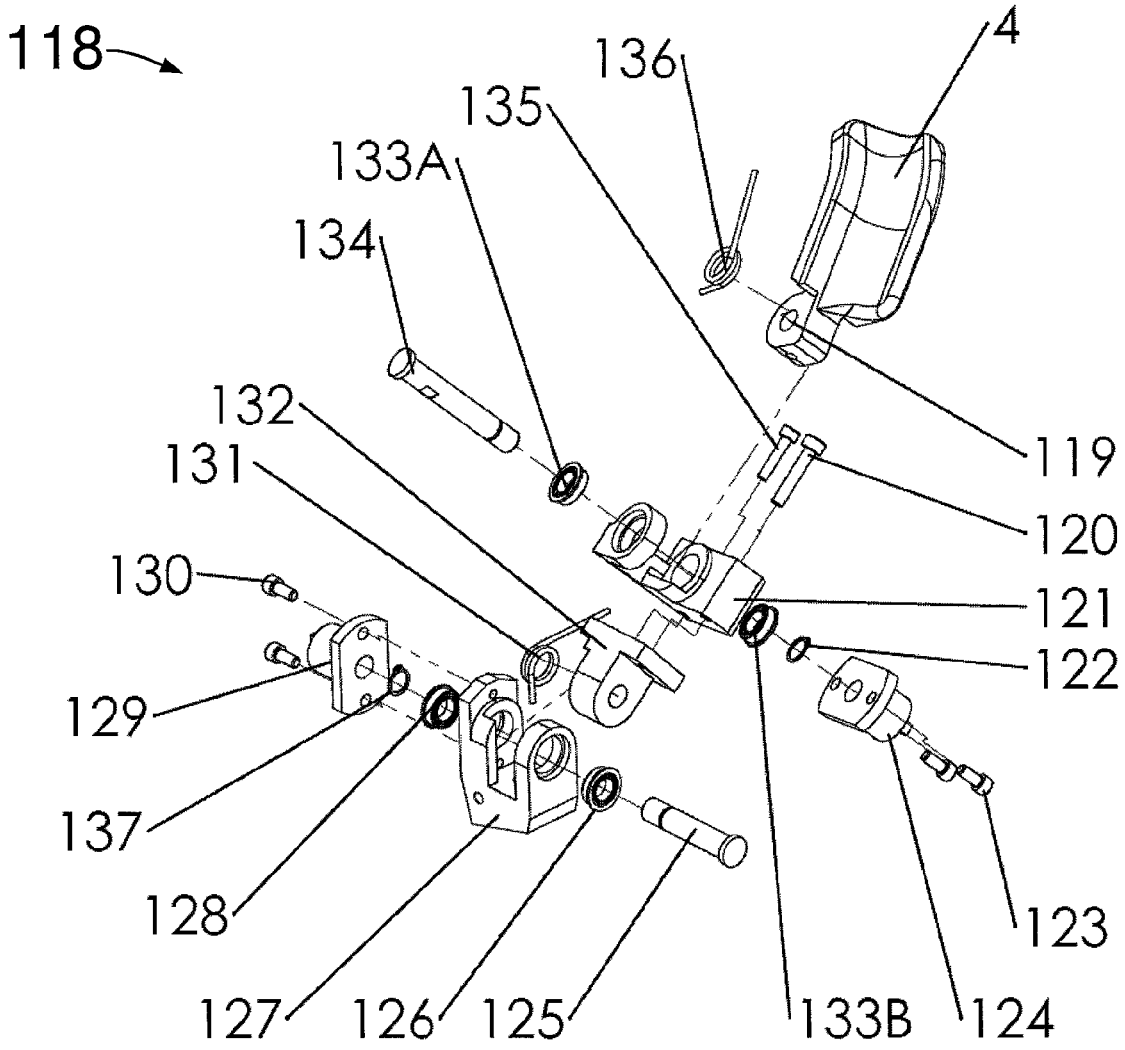
FIG. 20 illustrates an exploded view of the thumb motion subassembly of an 11 degree of freedom joystick assembly, where the thumb motion subassembly measured the deflection of the thumb flexion and thumb rotation degrees of freedom.

An exploded view of thumb motion subassembly 118 is shown in FIG. 20. Thumb paddle 4 is attached to thumb flexion bracket 121 with flanged shaft 134, flanged bearings 133A and 133B, torsion return spring 136, and retaining clip 122. Shaft 134 is fixed to thumb flexion bracket 121 so that there is no relative motion between the two. Rotary potentiometer 124 is mounted to thumb flexion bracket 121 using fasteners 123 and measures the rotation of shaft 134 (and therefore flexion of thumb paddle 4) with respect to thumb flexion bracket 121. Bracket 132 is attached to thumb flexion bracket 121 using fasteners 120 and 135. Bracket 132 is also attached to thumb rotation bracket 127 with flanged shaft 125, flanged bearings 126 and 128, torsion return spring 131, and retaining clip 137. Shaft 125 is fixed to thumb rotation bracket 127 so that there is no relative motion between the two. Rotary potentiometer 129 is mounted to thumb rotation bracket 127 using fasteners 130 and measures the rotation of shaft 125 (and therefore rotation of thumb paddle 4) with respect to thumb flexion bracket 127. It should be appreciated that the several components mentioned in the embodiments disclosed herein can be secured together by any known means for doing so, and that the components can be made from a variety of known materials. Moreover, two or more of the several components can be made of one piece, if so desired.

In operation the human operator places his or her arm on the high DoF joystick assembly as shown in FIG. 2. The operators arm contacts index finger paddle 3 with his or her index finger, middle finger paddle 2 with his or her middle finger, thumb paddle 4 with his or her thumb, support plate 109 with his or her palm, and support plate 102 with his or her ring and small fingers, palm edge support 98, and forearm bracket 5 with his or her forearm. In use, moreover, the operator may actuate one or more of the paddles using different digits, for example, operating paddle 3 using the middle finger and operating paddle 2 using the fourth (ring) finger.

By flexing and extending his or her index and/or middle fingers the operator may cause motion of index finger paddle 3 (as is shown in FIG. 10) and/or middle finger paddle 2 (as is shown in FIG. 11) without causing motion of any other degree of freedom of the high DoF joystick assembly. The torsional return springs 114 and 108 will cause index finger paddle 3 and middle finger paddle 2 to return to the fully extended position if the operator exerts no force on the paddles. In this manner the operator may move index finger paddle 3 and middle finger paddle 2 through their entire range of motion only by pushing on the paddles with a varying degree of force.

By flexing his or her thumb the operator may cause motion of thumb paddle 4 about the cylindrical axis of shaft 134 (as is shown in FIG. 12) without causing motion of any other degree of freedom of the high DoF joystick assembly. Torsional return spring 136 will cause thumb paddle 4 to return to the fully extended position if the operator exerts no force on the paddle. In this manner the operator may move thumb paddle 4 through its entire flexural range of motion only by pushing on the paddle with the ventral surface of his or her thumb with a varying degree of force.

By abducting or adducting his or her thumb the operator may cause motion of thumb paddle 4 about the cylindrical axis of shaft 125 (as is shown in FIG. 13) without causing motion of any other degree of freedom of the high DoF joystick assembly. Torsional return spring 131 will cause thumb paddle 4 to return to the fully rotated position if the operator exerts no force on the paddle. In this manner the operator may move thumb paddle 4 through its entire rotational range of motion only by pushing on the paddle with the side of his or her thumb with a varying degree of force.

With the force exerted by his or her palm acting on support plate 109, ring and small fingers on support plate 102, and palm on palm edge support 98, the operator may push away from his or her body or pull toward his or her body along the long axis of his or her forearm (assuming the operator's wrist is not flexed nor has any radial and ulnar deviation) and thus as is shown in FIG. 4 cause motion of linear bearing assembly 10 (the Y direction of XYZ stage 7) without causing motion of any other degree of freedom of the high DoF joystick assembly. In this particular case, none of the three degrees of freedom of wrist angle stage 8 will move in response to the force exerted generated by the operator because the force creates no moment about any of the axes of motion of wrist angle stage 8.

Similarly, with the force exerted by his or her palm acting on support plate 109, ring and small fingers on support plate 102, and palm on palm edge support 98, the operator may push away from his or her body or pull toward his or her body along a horizontal axis perpendicular to the long axis of his or her forearm (assuming the operator's wrist is not flexed, nor has any radial and ulnar deviation) and thus as is shown in FIG. 5 cause motion of linear hearing assembly 11

(the X direction of XYZ stage 7) without causing motion of any other degree of freedom of the high DoF joystick assembly. In this particular case none of the three degrees of freedom of wrist angle stage 8 will move in response to the force exerted generated by the operator because the force creates no moment about any of the axes of motion of wrist angle stage 8.

Also similarly, with the force exerted by his or her palm acting on support plate 109, ring and small fingers on support plate 102, and palm on palm edge support 98, the operator may push vertically downwards or pull vertically upwards along a vertical axis perpendicular to the long axis of his or her forearm (assuming the operator's wrist is not flexed nor has any radial and ulnar deviation) and thus as is shown in FIG. 3A cause motion of links 18A, 18B, and 18C (the Z direction of XYZ stage 7) without causing motion of any other degree of freedom of the high DoF joystick assembly. In this particular case none of the three degrees of freedom of wrist angle stage 8 will move in response to the force exerted generated by the operator because the force creates no moment about any of the axes of motion of wrist angle stage 8.

With the moment exerted by his or her palm acting on support plate 109 and ring and small fingers on support plate 102, the operator may pronate or supinate his or her wrist and thus cause motion of wrist rotation yoke 61 (as is shown in FIG. 6) without causing motion of any other degree of freedom of the high DoF joystick assembly. In this particular case none of the three degrees of freedom of XYZ stage 7 will move in response to the force exerted generated by the operator because the moment creates no force along any of the axes of motion of XYZ stage 7.

Similarly, with the moment exerted by his or her palm acting on support plate 109 and ring and small fingers on support plate 102, the operator may flex or extend his or her wrist and thus cause motion of wrist flexion link 97 (as is shown in FIG. 7) without causing motion of any other degree of freedom of the high DoF joystick assembly. In this particular case none of the three degrees of freedom of XYZ stage 7 will move in response to the force exerted by the operator because the moment creates no force along any of the axes of motion of XYZ stage 7.

Also similarly, with the moment exerted by his or her palm acting on support plate 109, palm on palm edge support 98 and ring and small fingers on support plate 102, the operator may cause radial and ulnar deviation of his or her wrist and thus cause motion of wrist deviation yoke 91 (as is shown in FIG. 8) without causing motion of any other degree of freedom of the high DoF joystick assembly. In this particular case none of the three degrees of freedom of XYZ stage 7 will move in response to the force generated by the operator because the moment creates no force along any of the axes of motion of XYZ stage 7.

By using his or her forearm to exert a force on forearm bracket 5 perpendicular to the long axis of forearm link 6, the operator may cause motion of forearm angle stage 9 (as is shown in FIG. 9) without causing motion of any other degree of freedom of the high DoF joystick assembly.

In addition to being able to move any individual DoF without moving other DoFs, the operator may move any combination of DoFs that she desires simultaneously or in any desired sequence.

Figure 21:
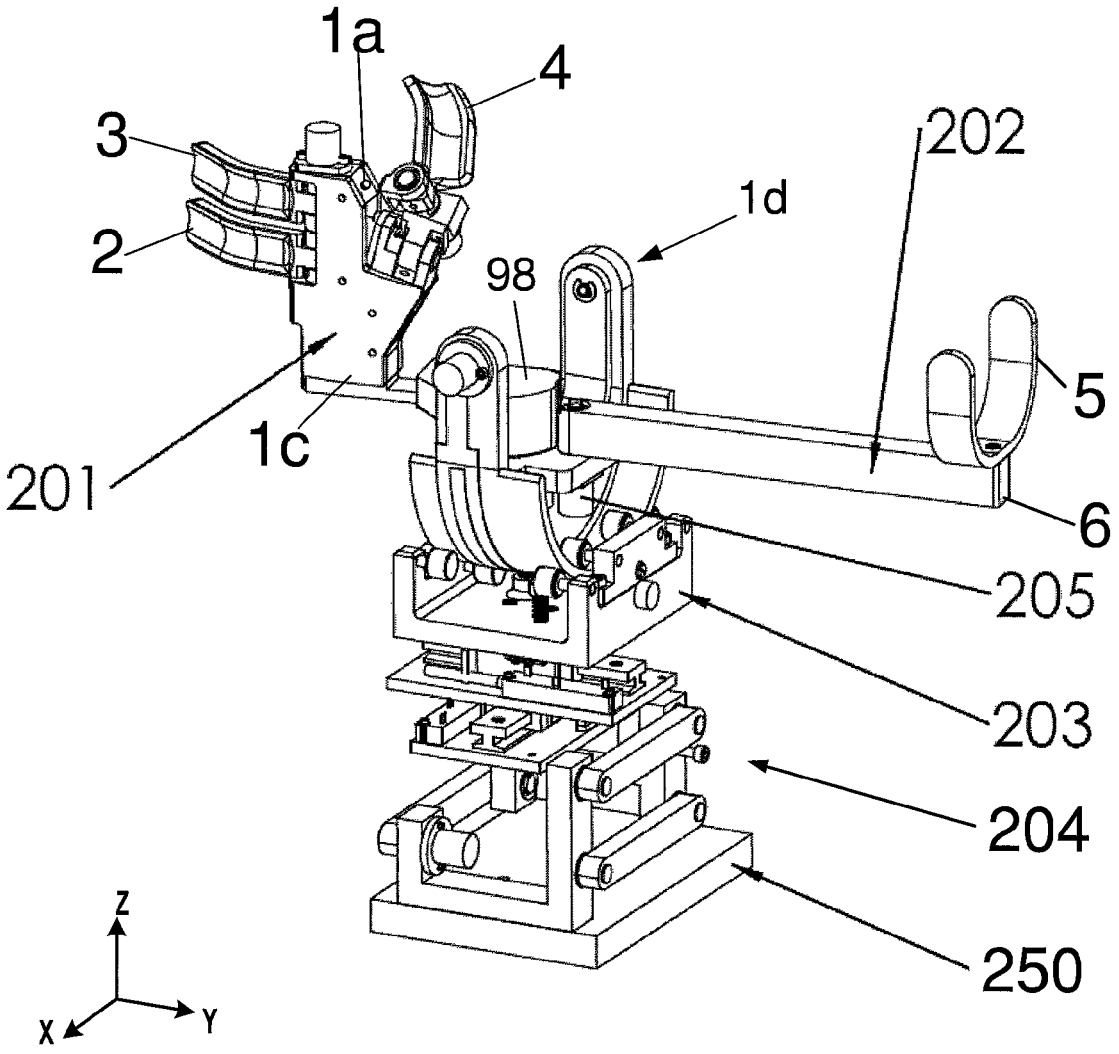
FIG. 21 illustrates an 11 degree of freedom joystick assembly with feedback actuators at each degree of freedom according to a second embodiment of the present disclosure.
Figure 22:
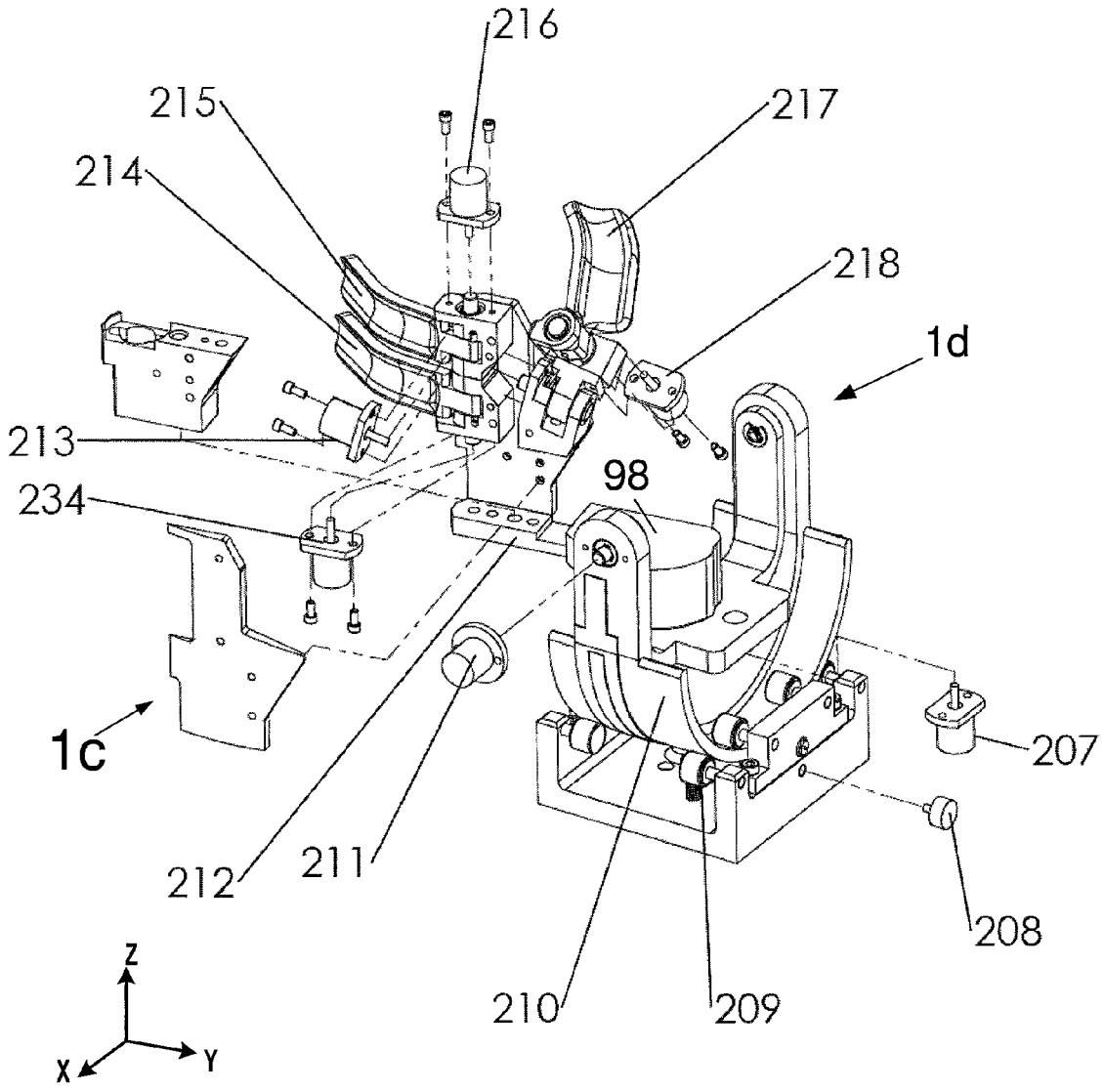
FIG. 22 illustrates a partially exploded view of the digit angle stage and the wrist angle stage of an 11 degree of freedom joystick assembly with feedback actuators at each degree of freedom.
Figure 23:
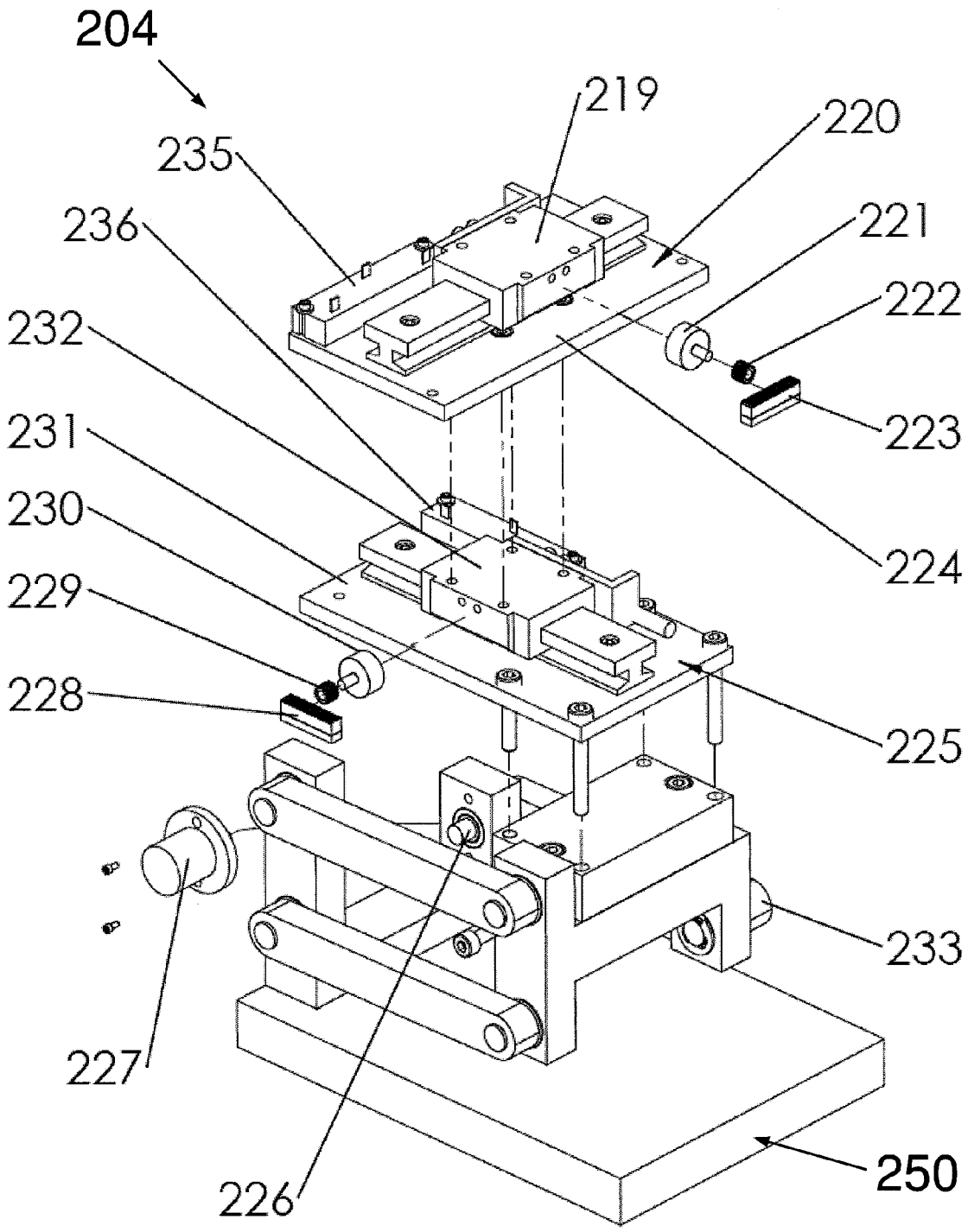
FIG. 23 illustrates a partially exploded view of the XYZ stage age of an 11 degree of freedom joystick assembly with feedback actuators at each degree of freedom.
Figure 24:
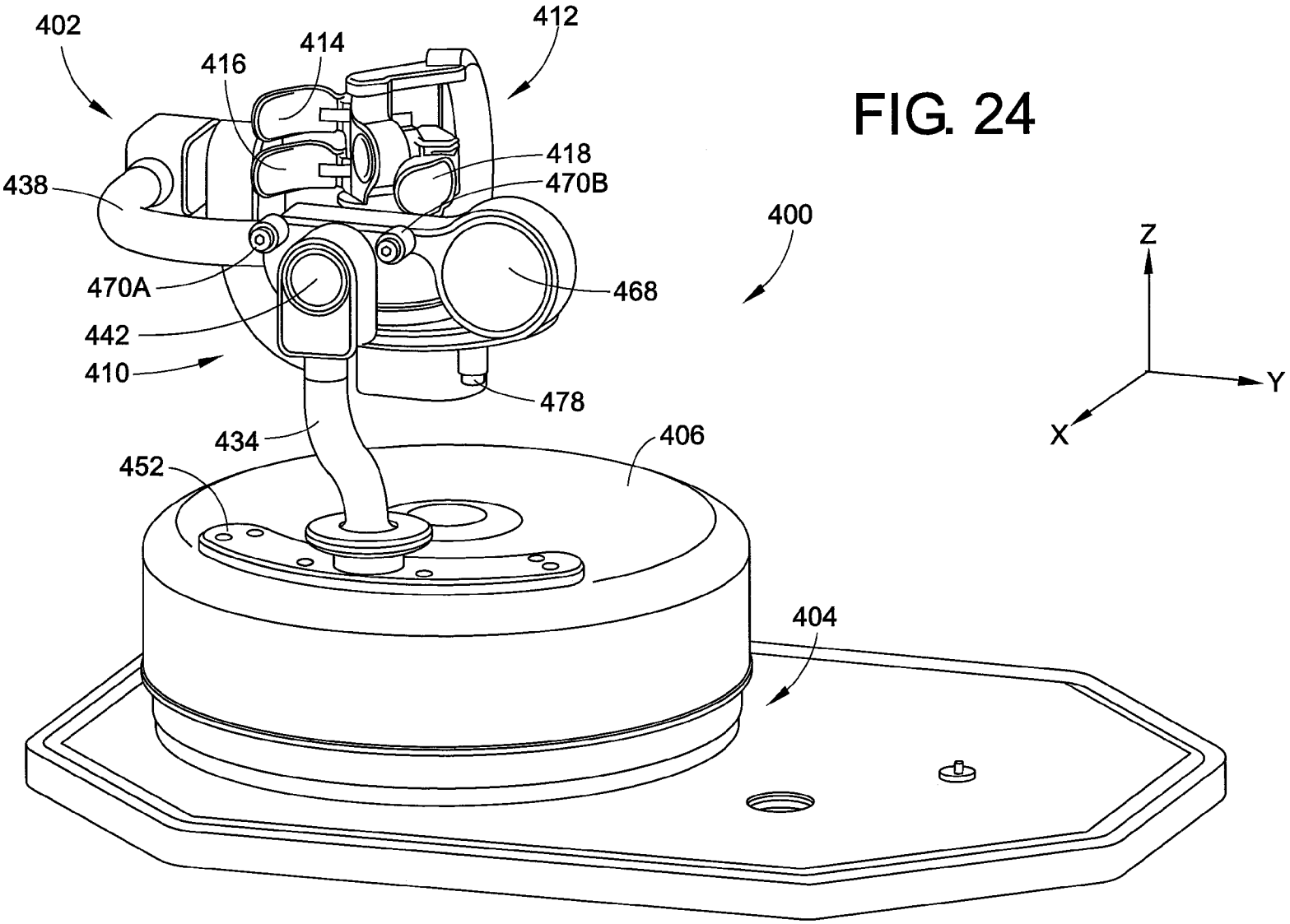
FIG. 24 is a perspective side view of another embodiment of the multiple degree of freedom joystick apparatus for controlling a machine having a base member with a strain gauge assembly.
Figure 25:
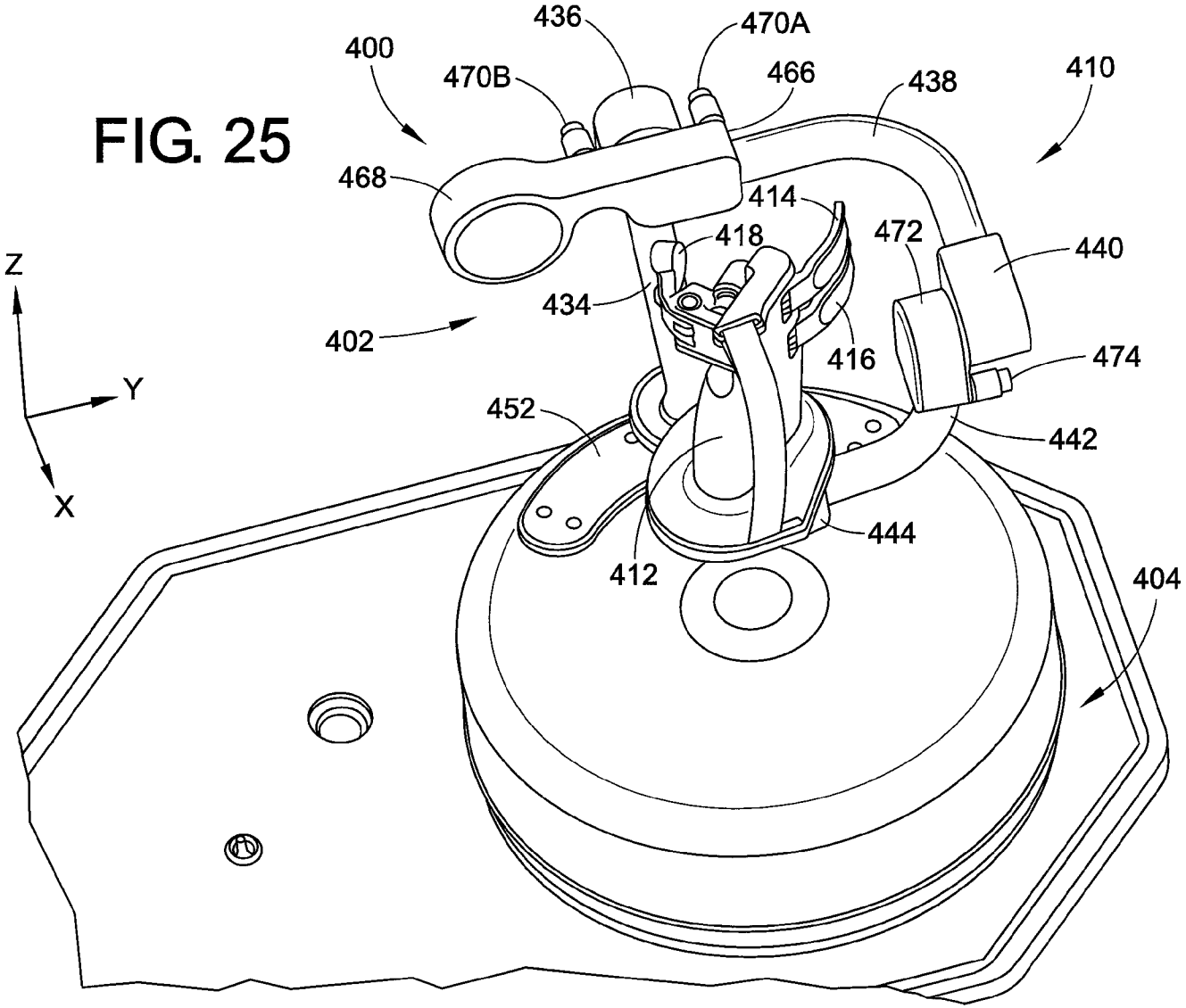
FIG. 25 is a perspective top view of the multiple degree of freedom joystick apparatus for controlling a machine including the base member and strain gauge assembly.
Figure 26:
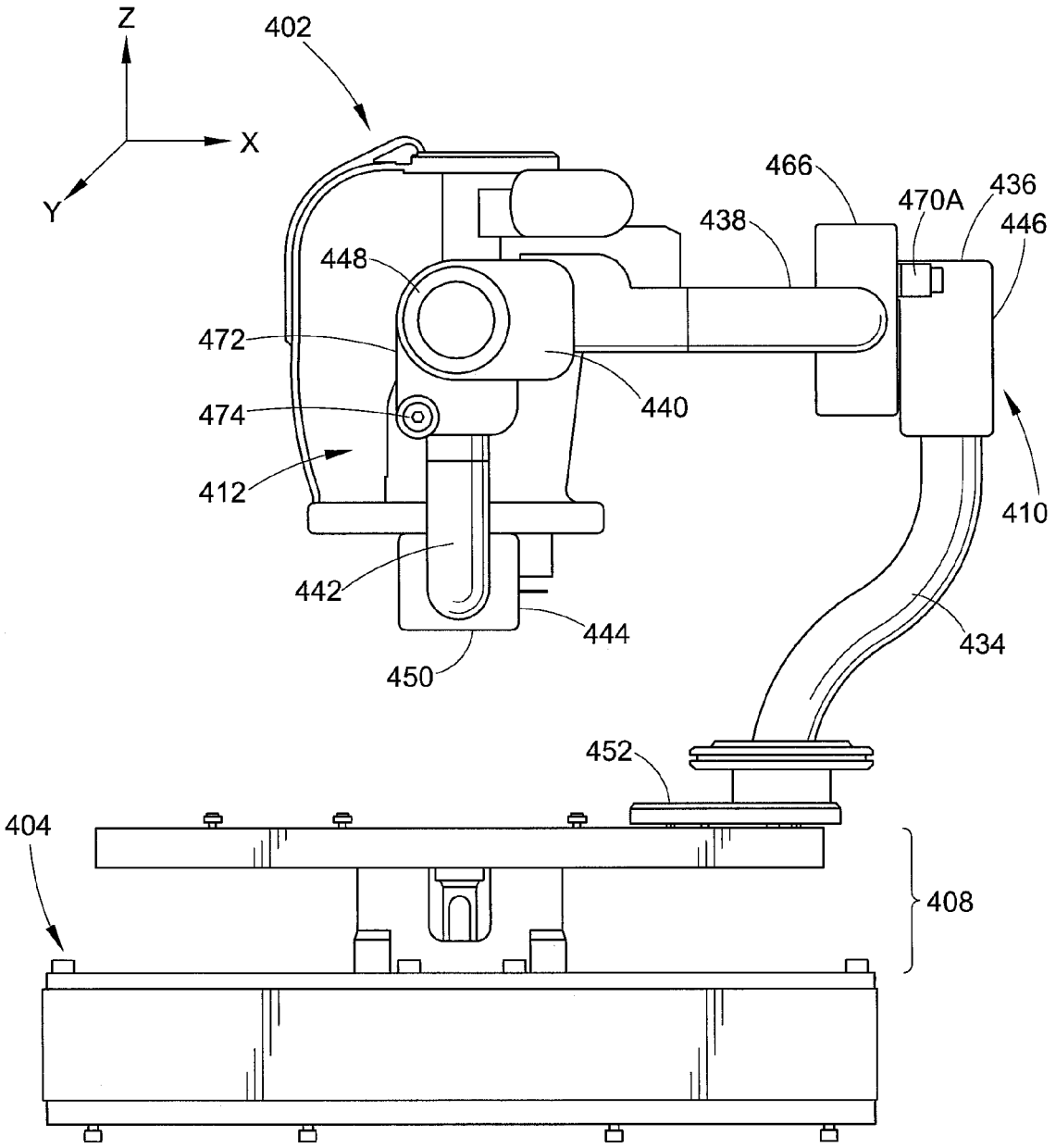
FIG. 26 is a front view of a first side of the multiple degree of freedom joystick apparatus for controlling a machine including the base member and strain gauge assembly without a skirt to cover the base member.
Figure 27:
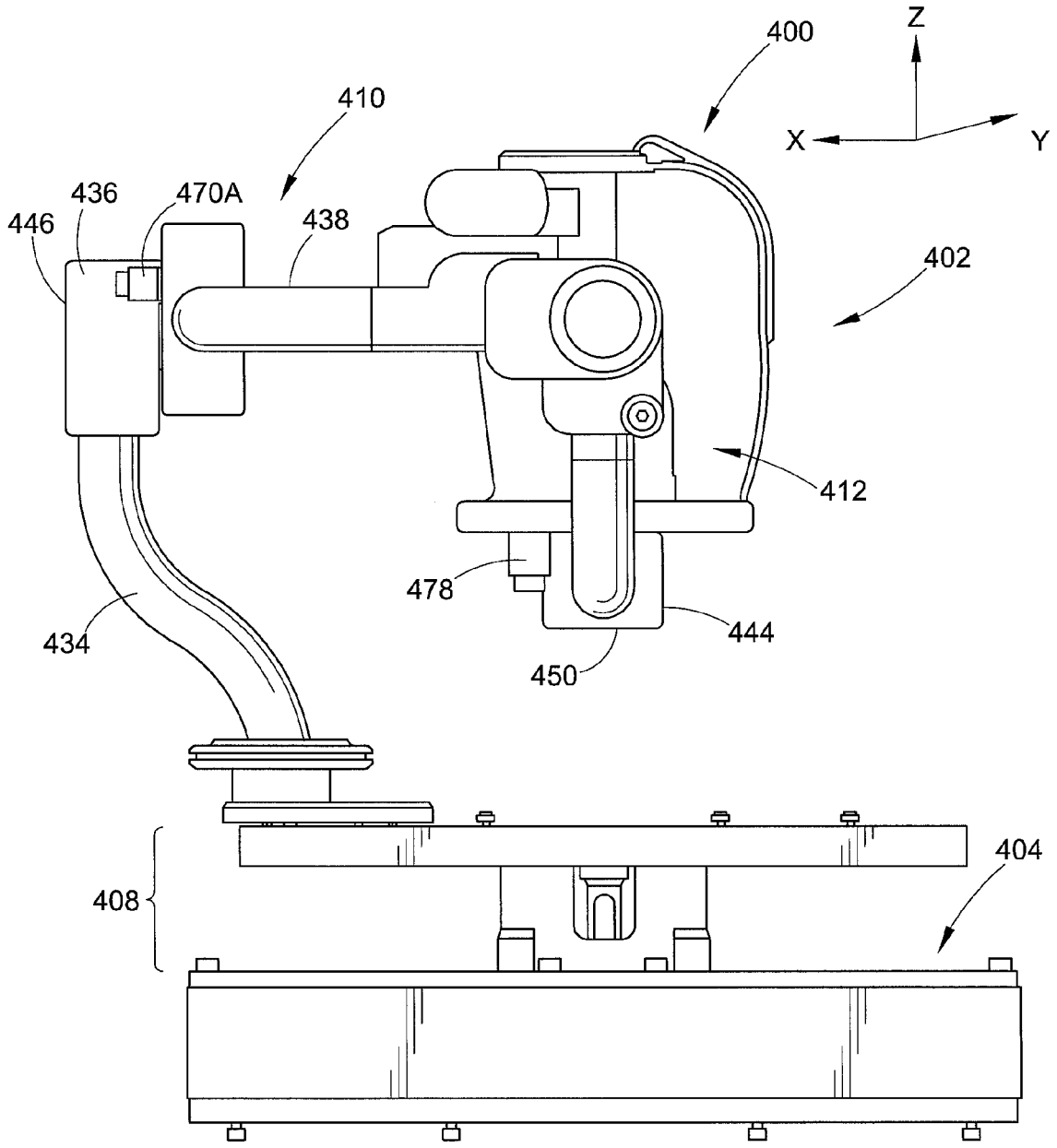
FIG. 27 is a front view of a second side of the multiple degree of freedom joystick apparatus for controlling a machine of FIG. 26.
Figure 28:
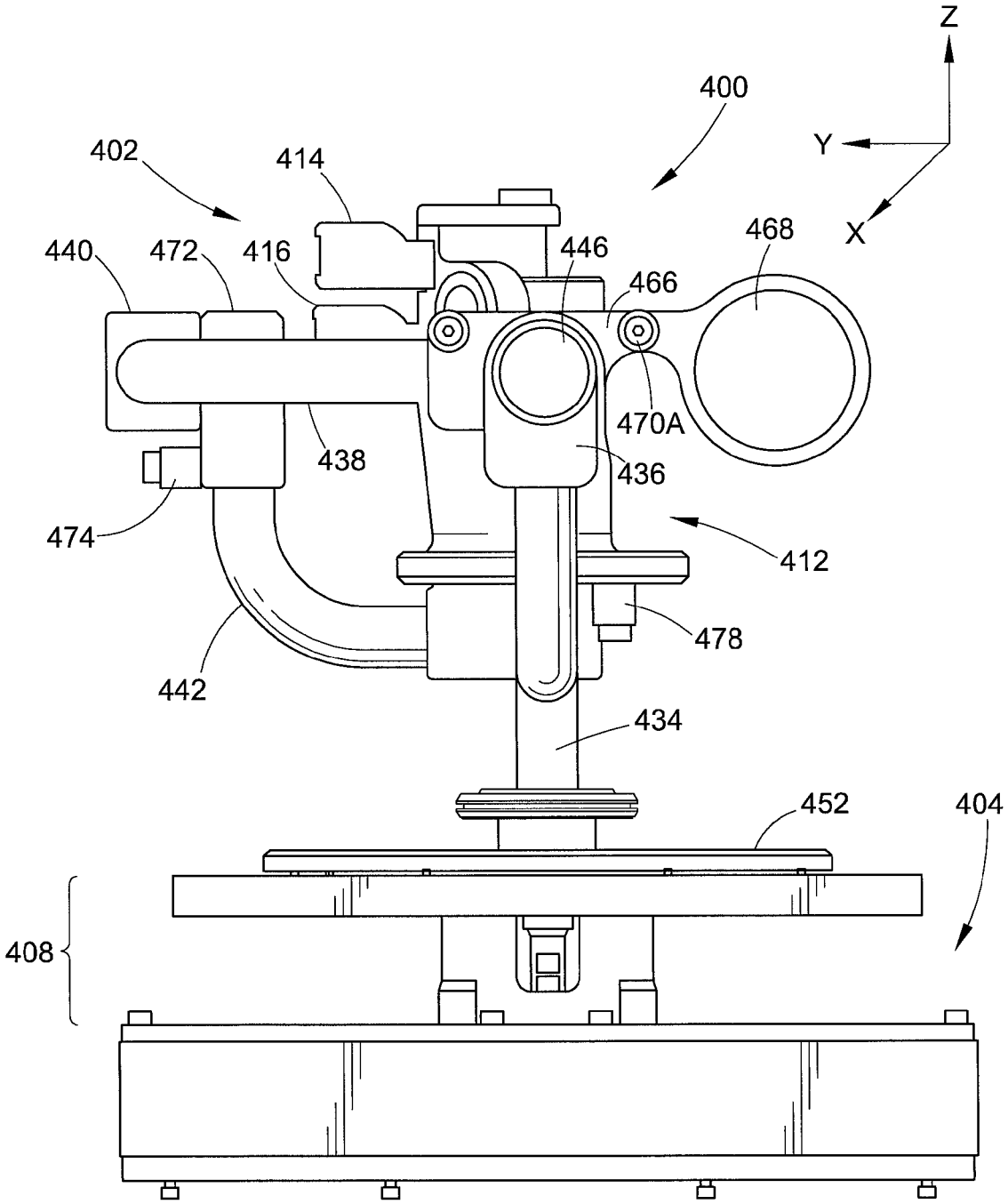
FIG. 28 is a front view of a third side of the multiple degree of freedom joystick apparatus for controlling a machine of FIG. 26.
Figure 29:
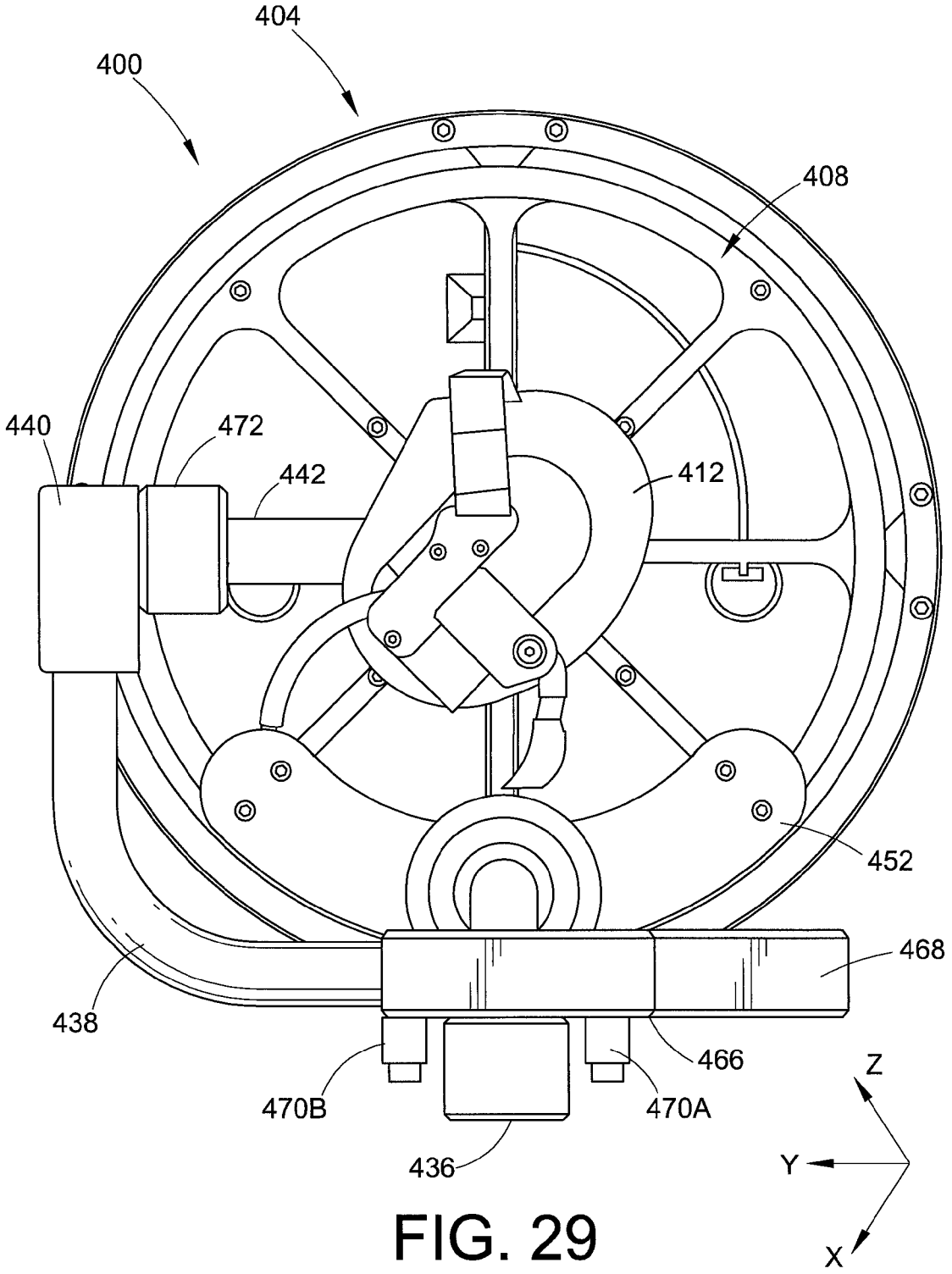
FIG. 29 is a top view of the multiple degree of freedom joystick apparatus for controlling a machine of FIG. 26.
Figure 30:
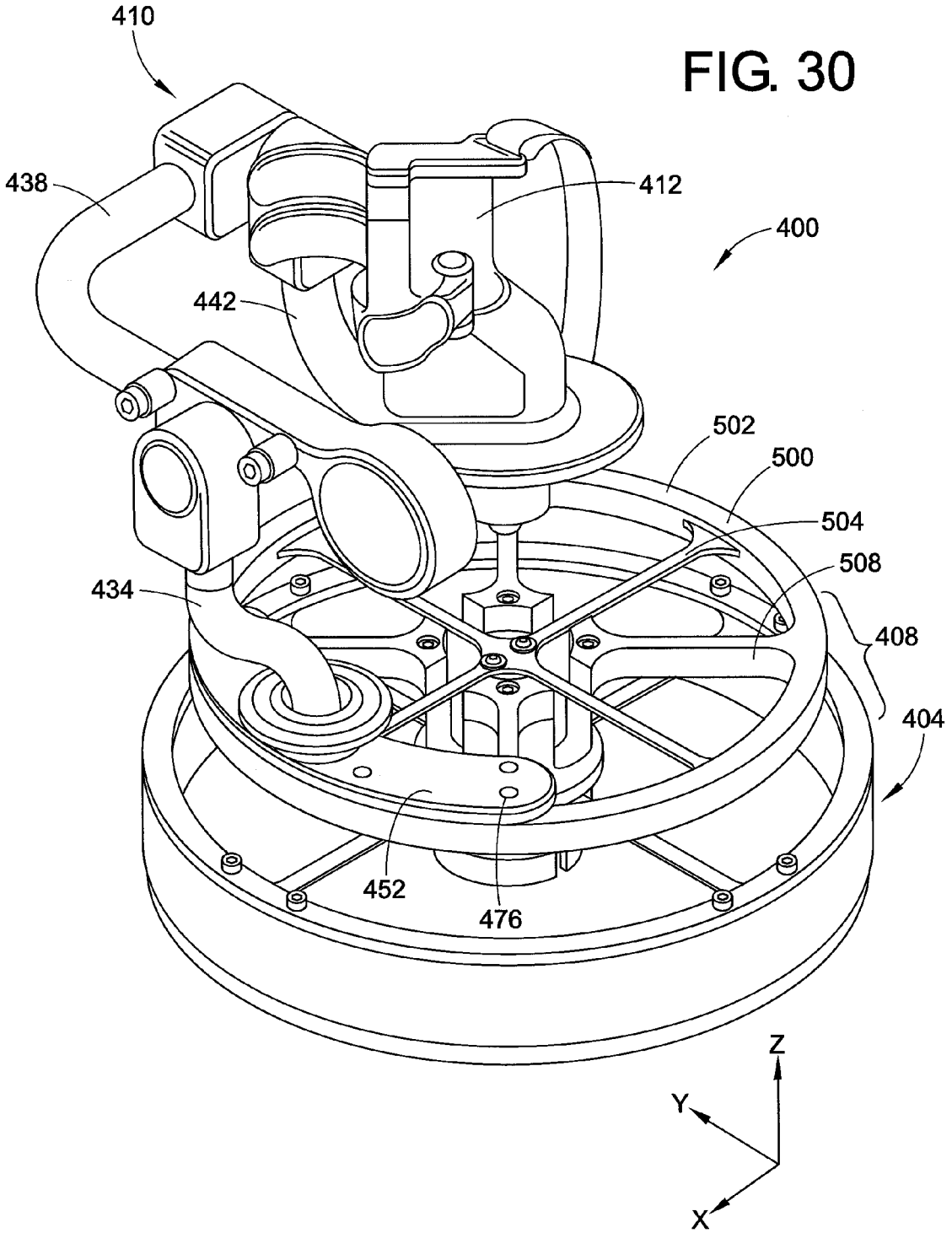
FIG. 30 is a perspective view of the multiple degree of freedom joystick apparatus for controlling a machine of FIG. 26 illustrating the strain gauge assembly.
Figure 31:
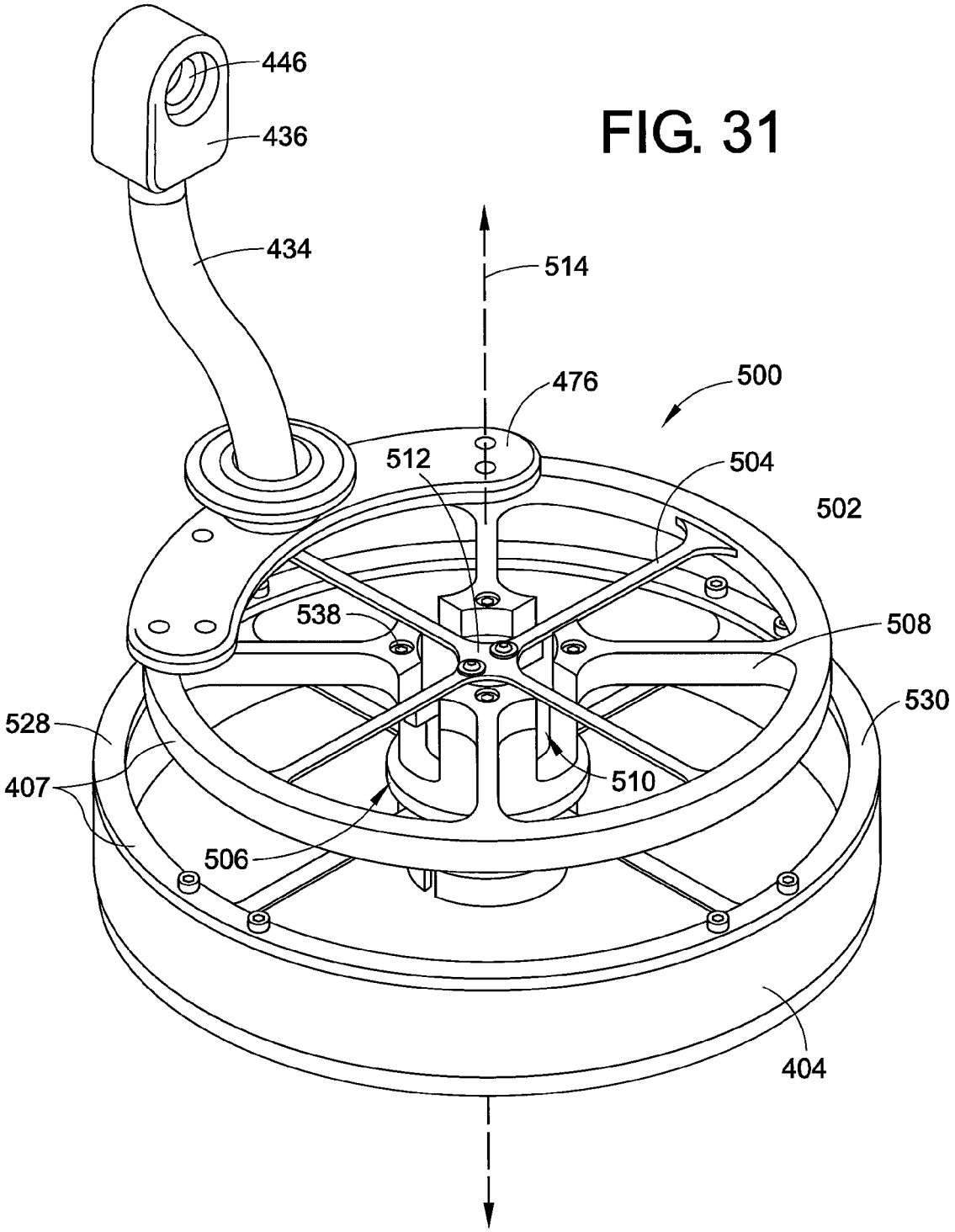
FIG. 31 is a perspective view of a portion of the multiple degree of freedom joystick apparatus for controlling a machine illustrating a cantilever arm attached to a spring plate.
Figure 32:
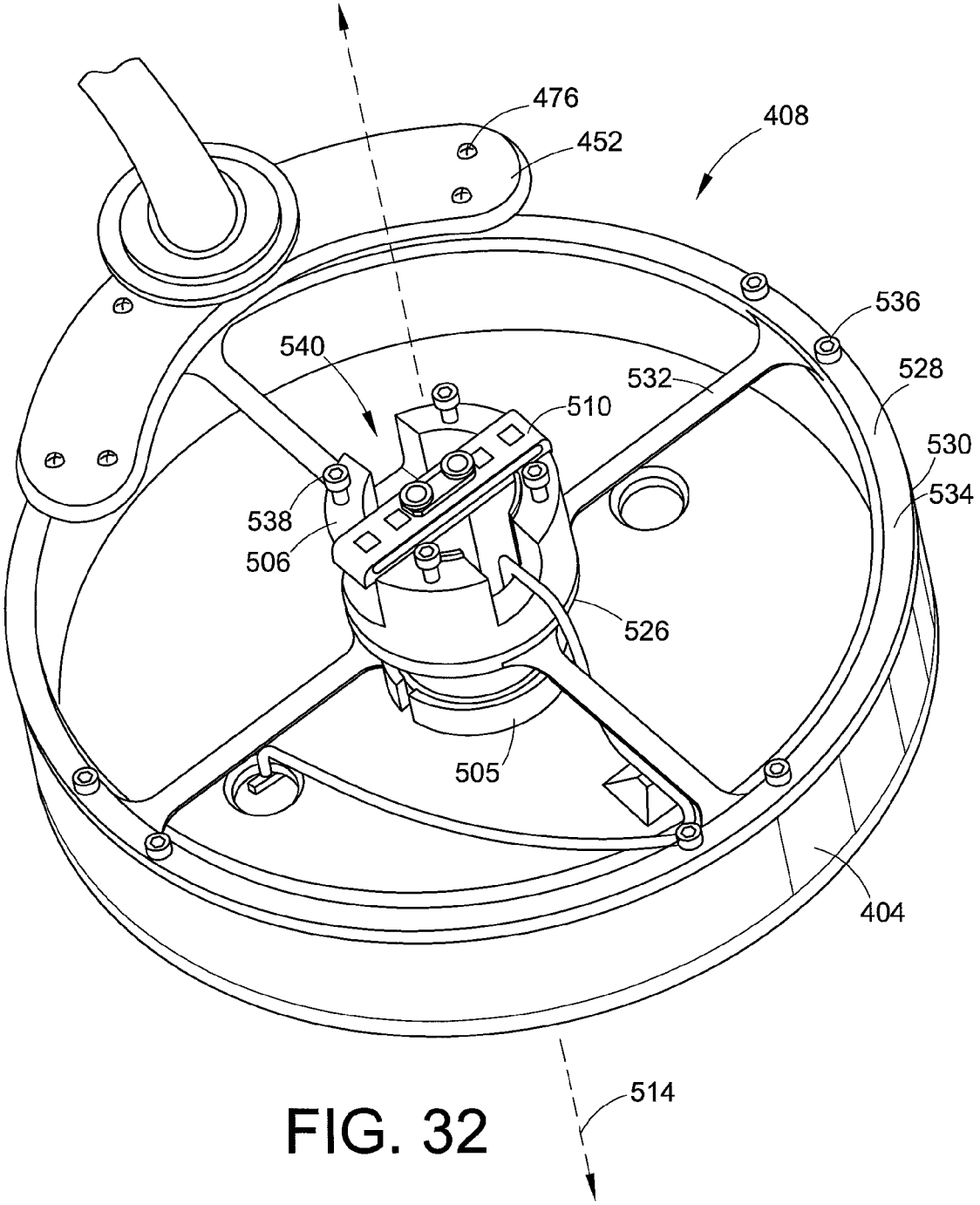
FIG. 32 is a top perspective view of a portion of the multiple degree of freedom joystick apparatus illustrating a load cell positioned within a central hub and attached to the base member.

A second embodiment of the high degree of freedom (DoF) joystick is shown in FIGS. 21-23, which differs from the first embodiment by having feedback actuators at each degree of freedom. As is shown in the drawings and particularly in FIG. 21, the joystick assembly comprises major subassemblies base 250, digit angle stage 201, XYZ stage 204, wrist angle stage 203, and forearm angle stage 202.

As is shown in FIG. 21, feedback actuator with integral position sensor 205 can exert torque on forearm angle stage 202 as well as sensing the position of forearm angle stage 202 with respect to wrist angle stage 203.

FIG. 22 shows the four feedback actuators for digit angle stage 201. In particular, feedback actuator with integral position sensing 216 can exert torque on index finger paddle 215 and feedback actuator with integral position sensing potentiometer 234 can exert torque on middle finger paddle 214. Similarly, feedback actuator with integral position sensing 218 can exert torque the flexion degree of freedom of thumb paddle 217 and feedback actuator with integral position sensing 213 an exert torque on the rotation degree of freedom of thumb paddle 217.

FIG. 22 also shows the three feedback actuators for wrist angle stage 203. In particular, feedback actuator with integral position sensing 208 drives a roller 209 that can exert torque on wrist rotation yoke 210. Feedback actuator with integral position sensing 211 can exert torque on wrist deviation yoke 210, and feedback actuator with integral position sensing 207 can exert torque on wrist flexion link 212.

FIG. 23 shows the three feedback actuators for XYZ stage 204. Motor 221 is attached to pinion gear 222 and also to linear bearing 219 of the linear bearing assembly 220 (the Y degree of freedom of XYZ stage 204). Rack 223 is attached to plate 224 of linear bearing assembly 220 and is in contact with pinion gear 222; motor 221 can thus drive pinion gear 222 and rack 223 to cause a reaction force between linear bearing 219 and plate 224. Linear motion between linear bearing 219 and plate 224 is measured by linear potentiometer 235.

Similarly, FIG. 23 shows that motor 230 is attached to pinion gear 229 and also to linear bearing 232 of the linear bearing assembly 225 (the X degree of freedom of XYZ stage 204). Rack 228 is attached to plate 231 of linear bearing assembly 225 and is in contact with pinion gear 229; motor 230 can thus drive pinion gear 229 and rack 228 to cause a reaction force between linear bearing 232 and plate 230. Linear motion between linear bearing 232 and plate 231 is measured by linear potentiometer 236.

Finally, FIG. 23 shows that feedback actuator with integral position sensing 227 is attached to shaft 226, which in turn can exert torque on output link 233, thus inducing force on the Z degree of freedom of XYZ stage 204.

In operation the human operator places his or her arm on the high DoF joystick assembly of the second embodiment in a manner identical to that of the high DoF joystick assembly of the first embodiment. Similarly, the human operator can cause motion of any or all of the degrees of freedom of the high DoF joystick of the second embodiment in any combination or sequence that he or she desires. During operation any or all of the feedback actuators 205, 207, 208, 211, 213, 216, 218, 221, 227, 230, and 234 can exert a force or torque on the particular degree of freedom to which the actuator is attached. Moreover, the actuation of the various components of the joystick assemblies causes generation of one or more signals or values indicating the deflection, position, speed, force, etc. associated with such actuation.

Figure 39:
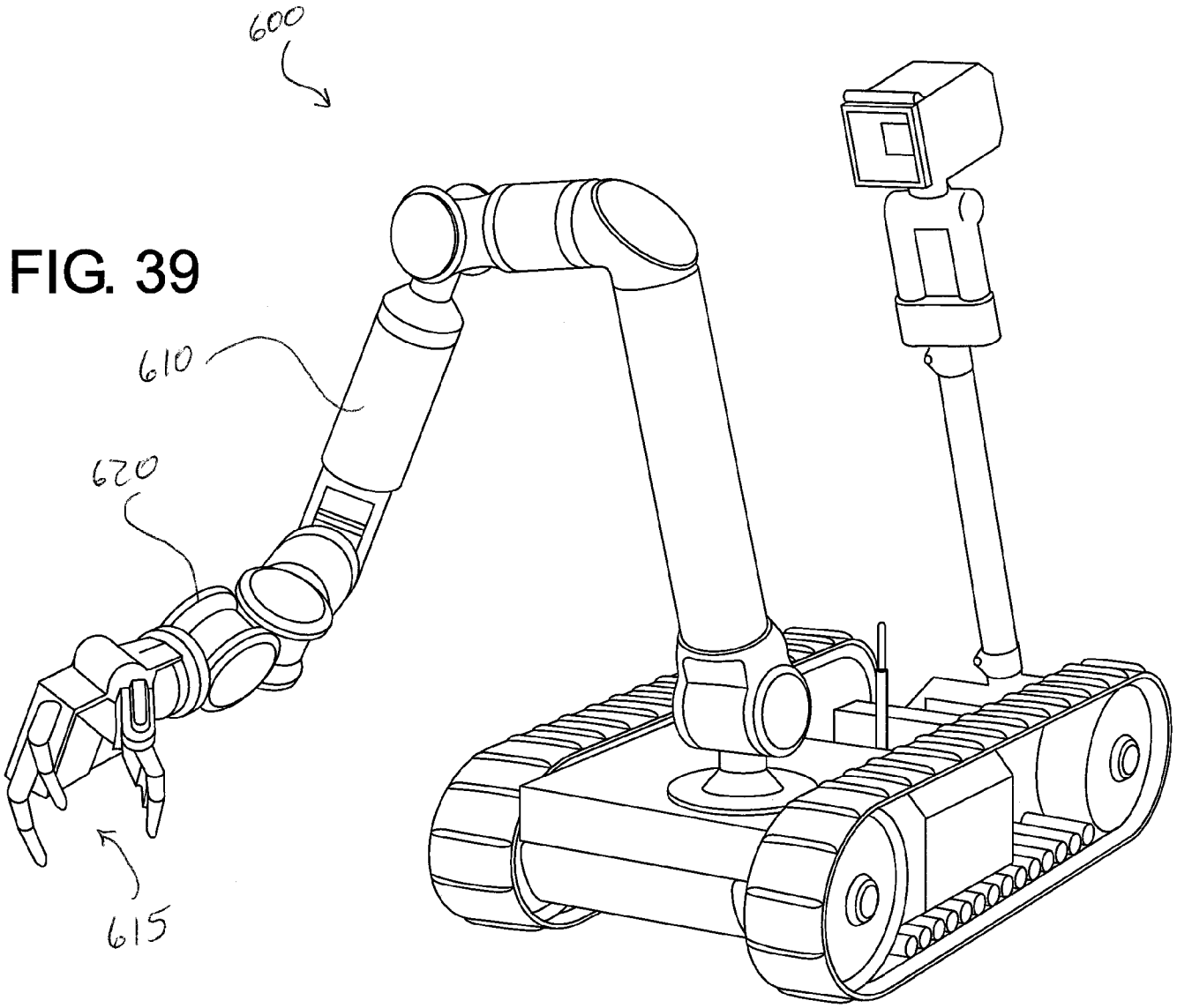
FIG. 39 is a picture of an associated robotic mechanism with a robotic arm and finger assembly.
Figure 40:
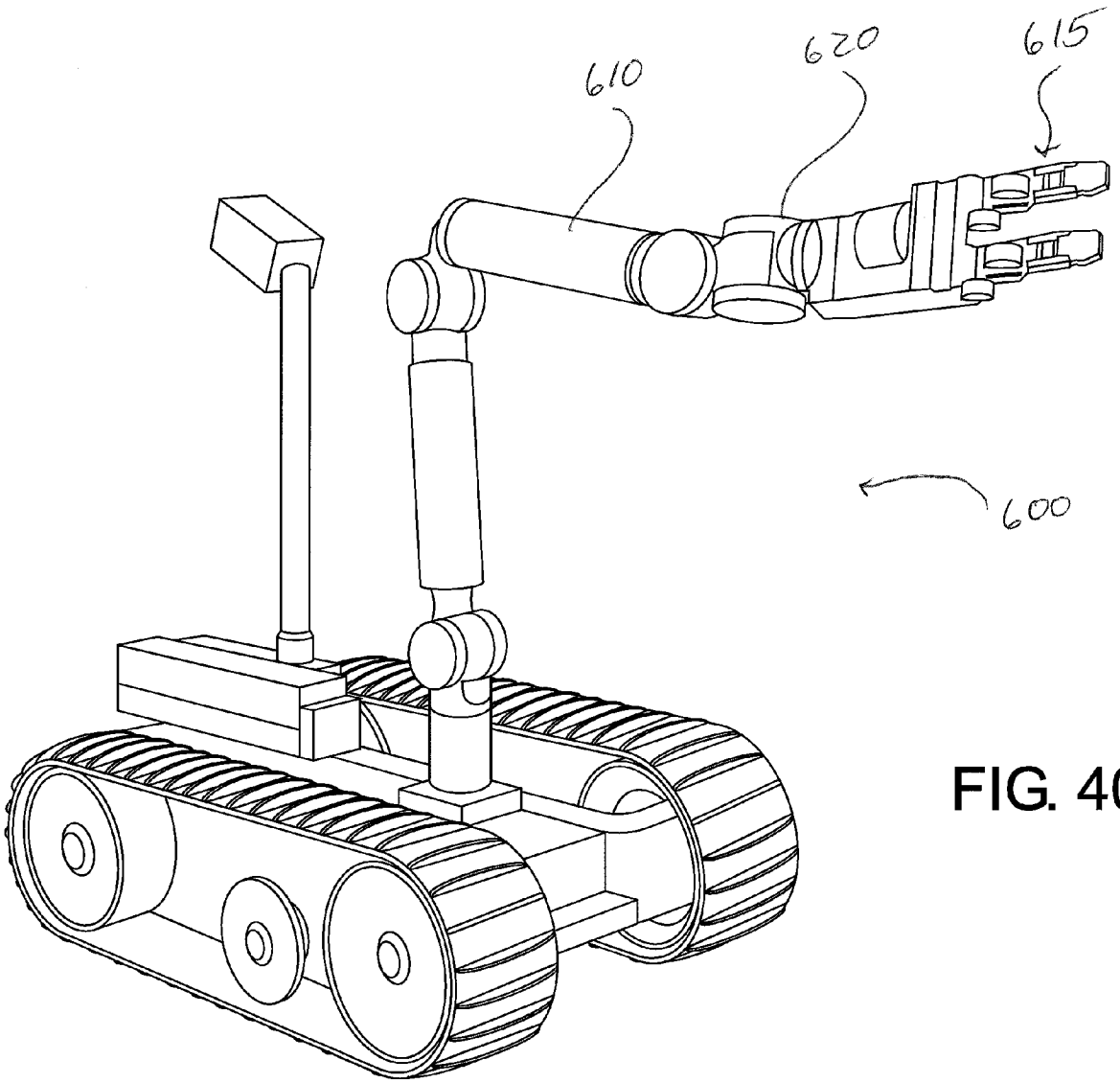
FIG. 40 is a picture of another associated robotic mechanism with a robotic arm and finger assembly.

FIGS. 24 through 40 illustrate another multiple degree of freedom joystick apparatus 400 for controlling a machine. This embodiment is configured to enable an operator to control a high-degree-of-freedom machine, for example a robotic mechanism 600 such as a robot arm 610. (See FIGS. 39 and 40)

The control apparatus 400 includes an actuator assembly 402 that is mounted to a base member 404. The base member 404 is attached to and supports a strain gauge assembly 408 that is movable due to deflection in orthogonal X, Y and/or Z directions indicated in the figures relative to the base member 404, and includes one or more strain gauge sensors providing signals and/or values indicating the position of the strain gauge assembly 408 relative to that of the base member 404 in the X, Y and/or Z direction. The actuator assembly 402 (similar to actuation assembly 301) is supported on the base member 404 (FIGS. 24-28). The actuator assembly 402 includes a wrist angle stage 410 that is movable relative to the base member 404 by operator hand, forearm or wrist motion, as well as a digit angle stage 412 (similar to digit angle stage 1) including at least one digit actuator 414, 416 and 418 that is movable by operator hand motion relative to the wrist angle stage 410 and/or base member 404.

Similar to the embodiments described and illustrated by FIGS. 1-23, the actuator assembly 402 including the wrist angle stage 410 and digit angle stage 412 are provisioned with position indicating/measuring sensors of any suitable types or types to provide signals or values indicating the positioning of the operator's hand, wrist, and digits. Suitable sensor types include without limitation, potentiometers, switches or switch arrays, linear-variable differential transformers (LVDTs), Hall effect sensors, electro-magnetic sensors such as proximity sensors, magnetic flux detectors, optical position sensors, or other sensors that provide one or more signals or values (analog or digital) indicating relative positioning (linear and rotational) of one or more actuator structures and other structures or assemblies as described herein. The apparatus 400 can be coupled with any suitable form of wired or wireless means for providing such sensor signals or values to a controlled machine or other intermediate system, details of which are omitted in the figures.

In the illustrated embodiments, the wrist angle stage 410 (particularly illustrated in FIGS. 24-30) includes one or more sensors that provide signals or values indicating the position of the wrist angle stage 410 with respect to rotation, flexion and/or deviation. The digit angle stage 412 is illustrated in FIGS. 36A, 36B, 36C, 37 and 38 and provides a three fingered joystick hand grip which can be used to control three fingers on a corresponding four degree of freedom robotic hand. (e.g. FIGS. 39 and 40). In general, the apparatus 400 can be operatively coupled with a robot arm or any other form of multi-degree of freedom actuator including end effectors, or any virtual system with multiple controllable degrees of freedom, where the individual signals or values provided by the sensors of the apparatus 400 can be used for controlling any degree of freedom of the robot arm or other controlled system. For example, digit actuators 414, 416 and 418 may be used in one possible implementation to control operation of finger and/or thumb digits 615 on a robotic arm 610 such as those shown in FIGS. 39 and 40, or alternatively, the signals and/or values provided by the sensors associated with the digit actuators 414, 416 and 418 may instead be used for controlling operation of other degrees of freedom of the driven robotic arm.

The digit angle stage 412 includes one or more sensors that provides signals or values indicating the position of the digit actuators 414, 416 and 418 with respect to the deflection of at least one of an index finger flexion, a middle finger flexion, a thumb flexion and/or a thumb rotation of the operator's hand. There is one degree of freedom in the finger digit actuators 414 and 416 and two degrees of freedom in the thumb paddle actuator 418 in this embodiment. Toggle switches (not shown—similar to toggle switch 1*a* above) and/or a dead man switch 420 (similar to dead man switch 1*b* above) can be positioned on the digit angle stage 412. This embodiment of the digit angle stage 412 includes a grip strap 422 that can be adjustable to secure an operator's hand thereon.

Finger digit actuators 414 and 416 are finger paddles that are attached, in this example, to a hand grip 424 of the digit angle stage 412 and are movable relative to a finger axis 464. Rotational sensors 426, 430 (FIG. 38) are provided to measure how far each paddle is rotated or depressed. Springs 428, 432 return the finger digit actuators 414, 416 to an original neutral position, thereby facilitating finger flexion and extension.

Thumb paddle actuator 418 is mounted on the hand grip 424 and is movable relative to a first thumb axis 454 (FIG. 37) to facilitate to flexion and extension and a second thumb axis 458 to facilitate abduction and adduction. A spring 462 is provided to return the thumb paddle actuator 418 to an original or neutral position. Rotational sensor 456 is provided at the first thumb axis 454 and rotational sensor 460 is provided at the second thumb axis 458. The sensors 456, 460 measure the angle that the thumb paddle is depressed or rotated. The signals from sensors 426, 430, 456 and 460 are then converted in the apparatus 400 or in a connected system into commands which control the position and speed of a corresponding finger and thumb 615 of the robotic arm 610 of the robot mechanism 600. As mentioned, the signals from the various sensors of the apparatus 400 may be analog signals (e.g., continuously variable voltages) generated by an appropriate sensor, or may be digital values, such as multi-bit values usable by a receiving digital system to indicate the relative position of the associated actuator. In certain implementations, analog signals and/or digital values may be provided from the apparatus 400 to a processor or other control circuit for use in generating command signals for operating a robot arm 610 or other actuation system (e.g., FIGS. 39 and 40), wherein the processor or control circuit may be integral to or separate from the apparatus 400 in various implementations. Moreover, such processor or control circuit may be formed as part of the controlled system (e.g., integrated into the apparatus 600 of FIGS. 39 and 40), or may be a separate intervening control unit with cabling and signaling the connection to the apparatus 400 and also to the controlled system.

The dead man switch 420 in one application can be used to activate the actuator assembly 402 and/or strain gauge assembly 408 when depressed and to deactivate it when the dead man switch 420 is released. The switch 420 can be depressed by the fourth and/or fifth fingers of the operator's hand in certain embodiments. When depressed, the operator activates the controller apparatus 400 and can manipulate the robot mechanism or other controlled system to be moved in space. When switch 420 is released, the controller 400 is deactivated whereby movement of the actuator assembly 402 or strain gauge assembly 408 will not move the robot mechanism.

Additionally, certain embodiments of the joystick apparatus 400 include one or more force and/or torque producing components that operate to provide force and/or torque to one or more of the actuators. The apparatus may further include one or more tactile actuators and other feedback components.

In order to capture the movement of the operator's wrist and control corresponding movements in the robot mechanism, the digit angle stage 412 is mounted on the wrist angle stage 410 that allows rotation about three independent axes. The wrist angle stage 410 allows the operator's wrist to flex and extend, to allow radial and ulnar deviation and pronation and supination of the forearm or wrist.

Turning to FIGS. 24-30, the wrist angle stage 410 of this embodiment includes a first cantilever arm 434, a second cantilever arm 438, and a third cantilever arm 442 that are configured into a three axis gimbal system. The first cantilever arm 434 is rotatably attached to the second cantilever arm 438 by a first bearing mount 436 and is rotatable along an X axis. The second cantilever arm 438 is rotatably attached to the third cantilever arm 442 by a second bearing mount 440 and is rotatable along a Y axis. The third cantilever arm is rotatably attached to the digit angle stage 412 by a third bearing mount 444 and is rotatable along a Z axis. The X, Y and Z axes are identified by the coordinate reference in FIGS. 24-30.

Rotational sensors 446, 448 and 450 are provided at each of the three axes of rotation at the first bearing mount 436, the second bearing mount 440 and the third bearing mount 444, respectively, to measure the angle of rotation of the operator inputs by the operator's wrist rotations. The signals or values from each of the sensors 446, 448 and 450 are converted into commands to control movement including, for example, the position and speed of an associated wrist segment 620 of the robotic mechanism such as the robotic arm 610.

The second cantilever arm 438 includes a shaft mount member 466 with a counterweight 468 that extends therefrom. The counterweight 468 assists to provide balance to the gimbal type actuator assembly 402 and can be adapted to allow the cantilever arms 434, 438, 442 to return to a neutral position after being manipulated by the operator. First and second gimbal bumpers 470A, 470B extend from the shaft mount member 466 and are positioned to restrict the range of rotation of the second cantilever arm 438 relative to the first cantilever arm 434 along the X axis. In this regard, bumpers 470A and 470B are configured to impact against the first bearing mount 436 when the second cantilever arm 438 is rotated to a desired limit relative to the first cantilever arm 434. Additionally, the third, cantilever arm 442 includes a shaft mount member 472 that supports an additional gimbal bumper 474 positioned to restrict the range of rotation of the third cantilever arm 442 relative to the second cantilever arm 438 along the Y axis. In this regard, bumper 474 is configured to impact against the second bearing mount 440 when the third cantilever arm 442 is rotated to a desired limit relative to the second cantilever arm 438. Similarly, a gimbal bumper 478 extends from the digit angle stage 412 and is positioned to restrict the range of rotation of the digit angle stage 412 relative to the third cantilever arm 442. Bumper 478 is configured to impact the third bearing mount 444 when the digit angle stage 412 is rotated to a desired limit relative to the third cantilever arm 442 along the Z axis.

The first cantilever arm 434 is supported above the base member 404 and is attached to a skirt 406 by a base plate 452. The skirt 406 covers a portion of the base member 404 and will be described in more detail below. The base plate 452 is attached to the skirt 406 by a plurality of conventional fasteners 476. In one embodiment the base plate 452 has a generally flat planar body configured in an arcuate shape to conform to a portion of the round shape of the skirt 406. However, this disclosure is not limiting as to the shape of the base member 404, skirt 406 or base plate 452 and other forms or shapes may be used.

FIGS. 26-28 and 30-35 illustrate the strain gauge assembly 408 of the controller apparatus 400. The strain gauge assembly 408 is adapted to generate directional command signals in X, Y and Z directions in response to an operator's movements to control the robot mechanism in three dimensional space. The strain gauge assembly 408 includes a spring plate 500 (e.g. FIG. 30) attached to a load cell 510 that is attached to the base member 404. In particular, the spring plate 500 includes an outer frame 502 that defines a perimeter of the spring plate 500. The base plate 452 of the actuator assembly 402 is attached to the outer frame 502 of the spring plate 500 and the skirt 406 by fasteners 476. Additionally, the skirt 406 is attached to the spring plate 500 at various locations within the outer frame 502 by fasteners 476. The spring plate 500 is directly attached to the load cell 510.

The load cell 510 is attached to a base platform 505 integral to the base member 404 and is positioned within a mounting tube or central hub 506 (FIG. 31) therein. The spring plate 500 includes thin spokes 504 which extend from a perimeter of the spring plate 500 and meet at an intersection 512 in an "X" shape. In this embodiment, the spring plate 500 is generally circular such that there are four thin spokes 504 intersecting at a center axis 514 of the circular perimeter defined by the outer frame 502. Other embodiments are possible using two or more spokes 504 positioned in any suitable symmetrical or asymmetrical pattern or configuration. The intersection 512 of the thin spokes 504 is attached directly to the load cell 510 in this embodiment. The central hub 506 is aligned along the central axis 514. The spring plate 500 also includes four thick arms 508 which radially extend from the central hub 506 located near the center of the base member 404 and are attached to the outer frame 502 of the spring plate 500. In this embodiment, the digit angle stage 412 is aligned along the central axis 514 at a position above the load cell 510 and spring plate 500.

The central hub 506 is supported on the base member 404. In the embodiment illustrated by FIG. 32, the central hub 506 is attached to a ground hub 526 which is attached to a ground spring plate or mounting ring 528. A plurality of ground spokes 532 radially extend from the ground hub 526 and attach to an outer ring 534 of the ground spring plate 528. The outer ring 534 of the ground spring plate 528 is attached to a rim 530 of the base member 404 by fasteners 536. A plurality of elongated fasteners 538 are configured to attach the thick arms 508 of the spring plate 500 to the central hub 506 and to the ground hub 526 of the ground spring plate 528. This orientation advantageously allows for a spring or bias force to be translated from the actuator assembly 402 directly to the load cell 510 in an ergonomic manner.

Figure 33:
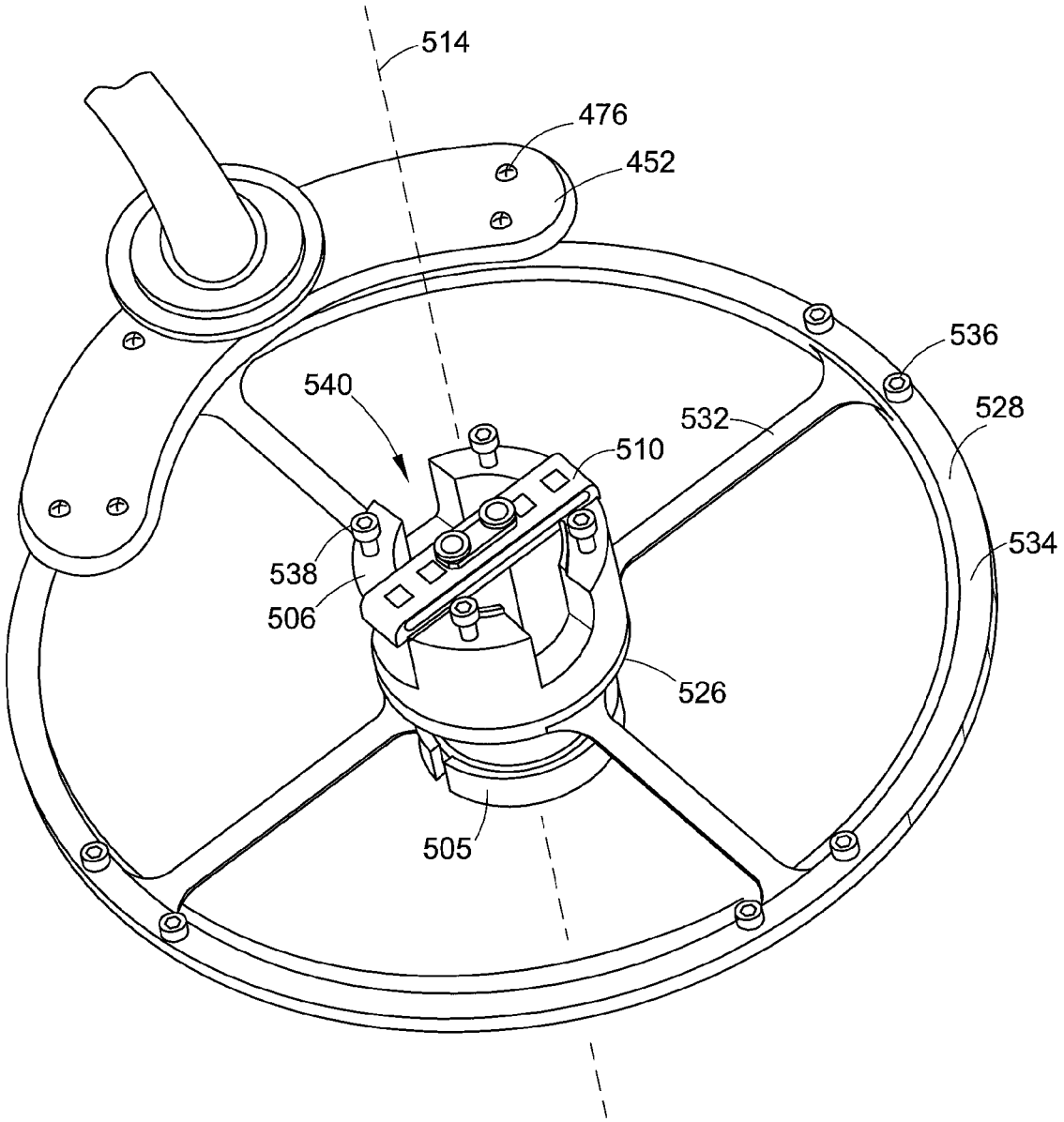
FIG. 33 is a top perspective view of a portion of the multiple degree of freedom joystick apparatus illustrating the load cell within the central hub.
Figure 34:
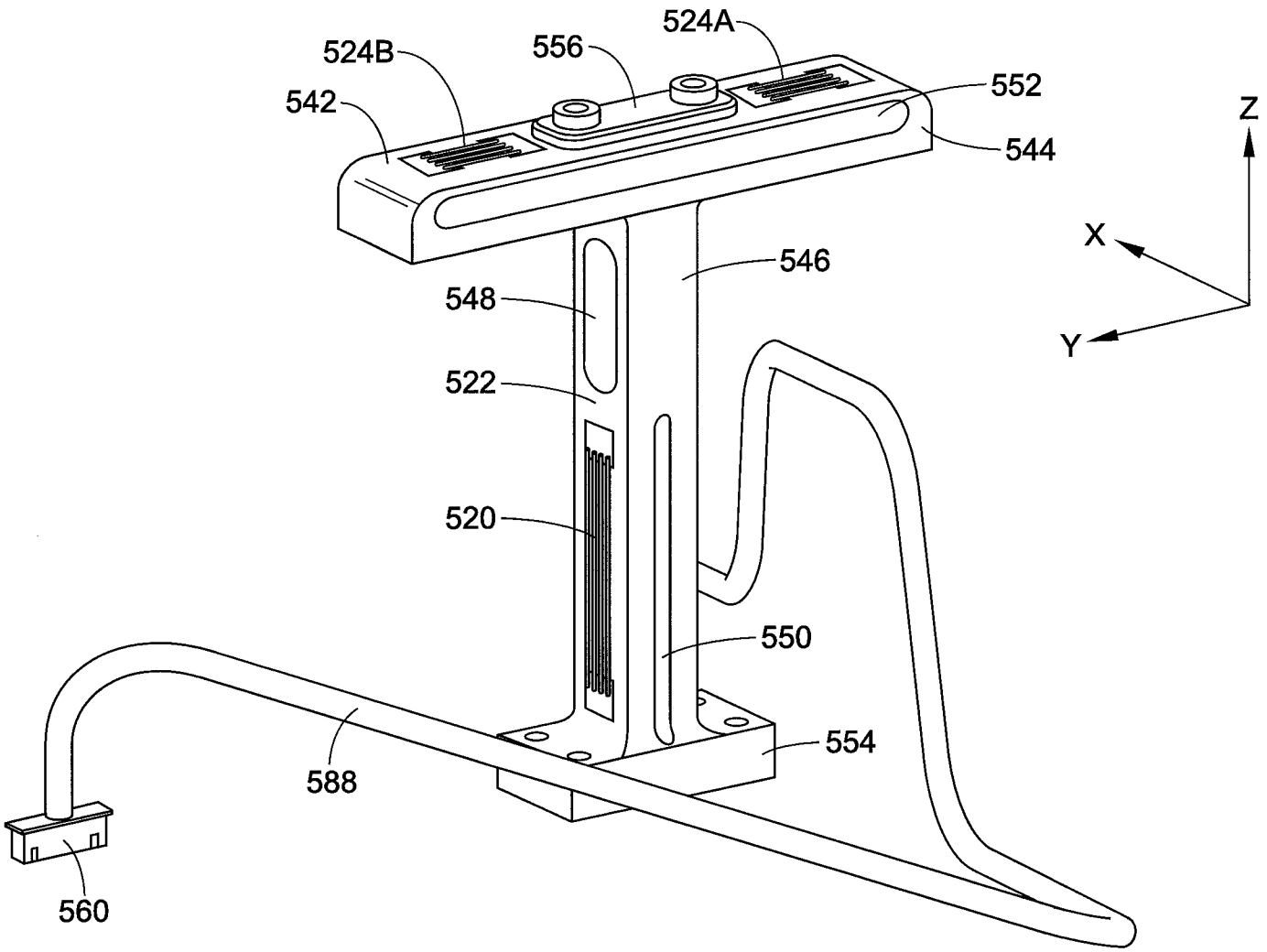
FIG. 34 is a perspective view of the load cell of the joystick apparatus of FIG. 32.
Figure 35:
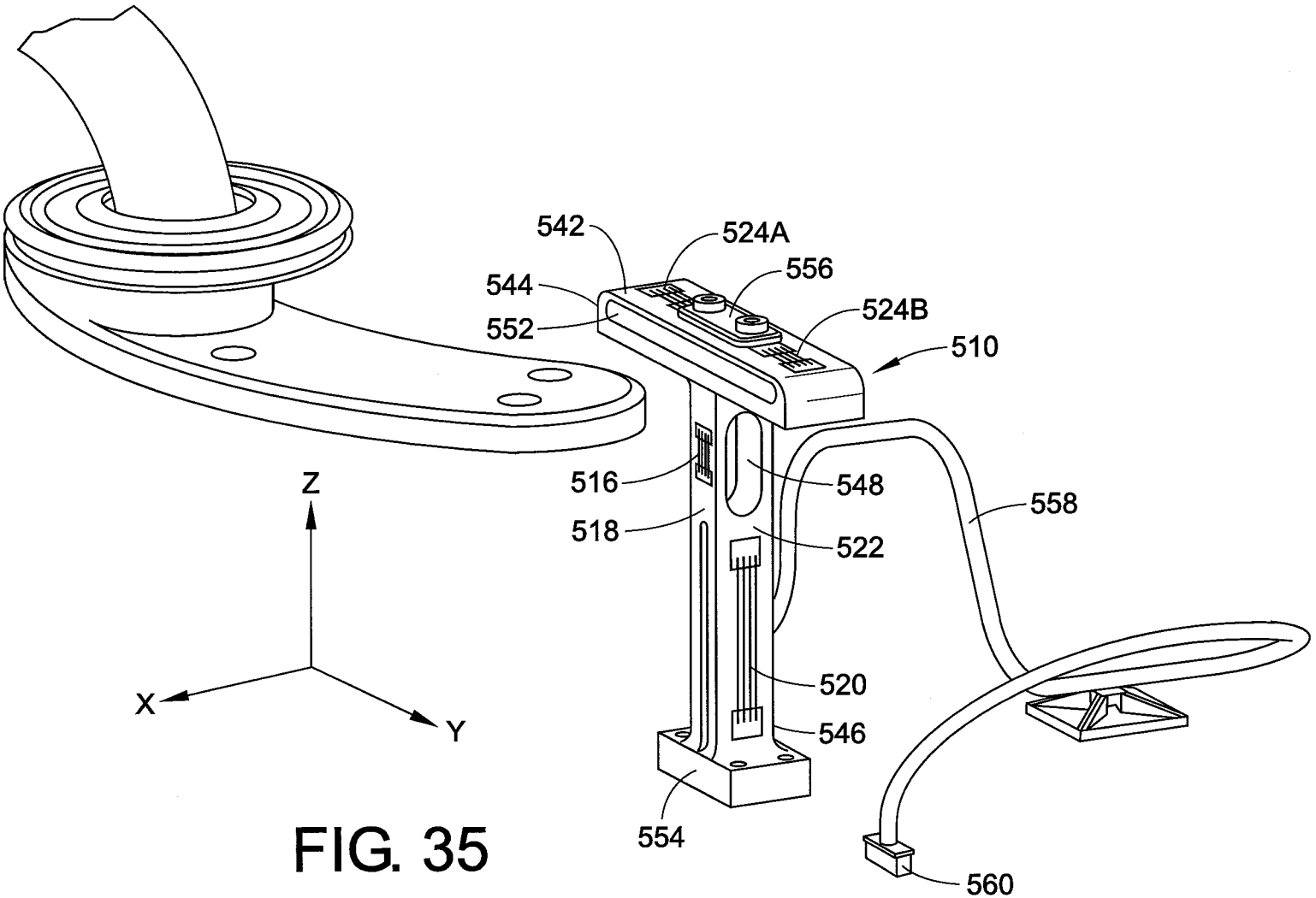
FIG. 35 is perspective view of the load cell of the joystick apparatus of FIG. 32 illustrated relative to the cantilever arm.
Figure 36A:
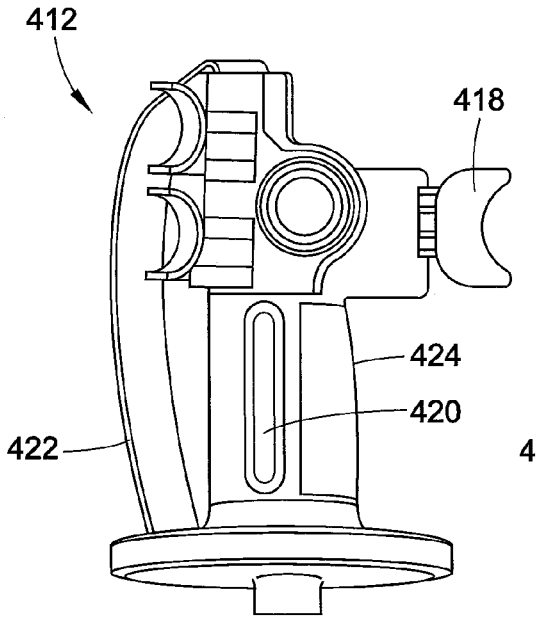
FIG. 36A is a front view of one side of a digit angle stage of the joystick apparatus of FIG. 24.
Figure 36B:
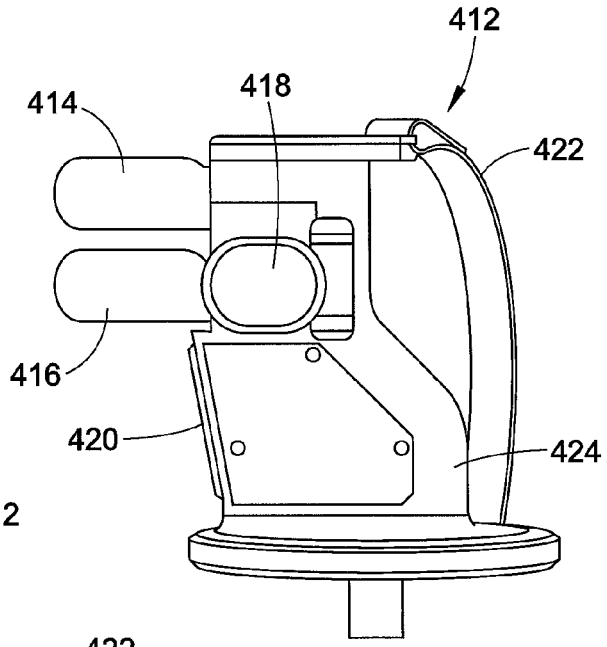
FIG. 36B is a front view of a second side of the digit angle stage of the joystick apparatus of FIG. 24.
Figure 36C:
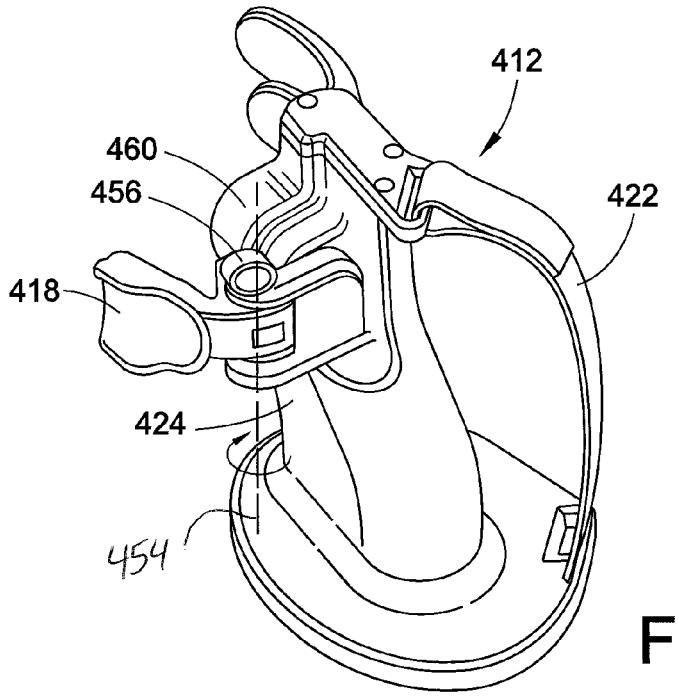
FIG. 36C is a perspective view of the digit angle stage of the joystick apparatus of FIG. 24.
Figure 37:
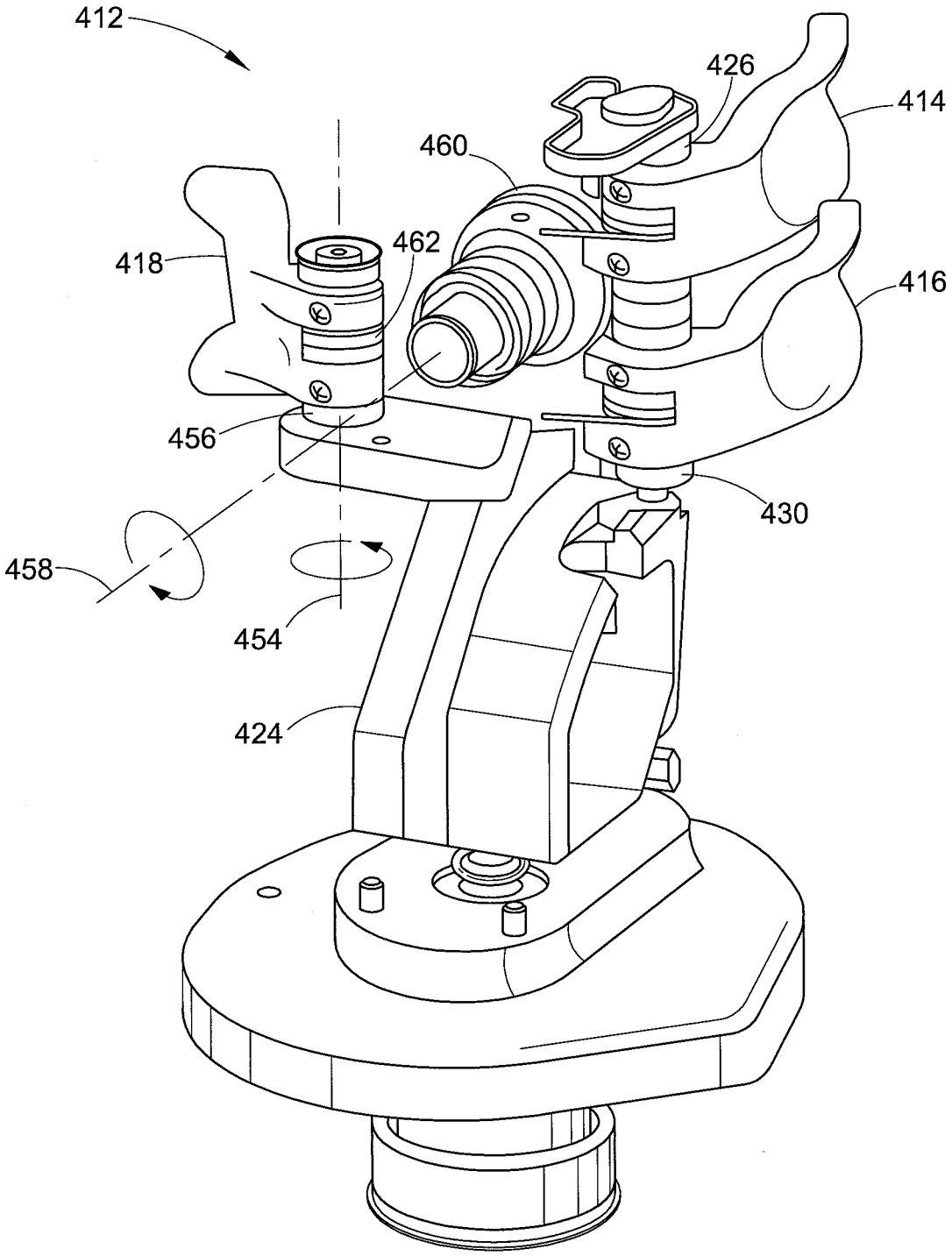
FIG. 37 is an enlarged front perspective view of the digit angle stage of the joystick apparatus of FIG. 24.
Figure 38:
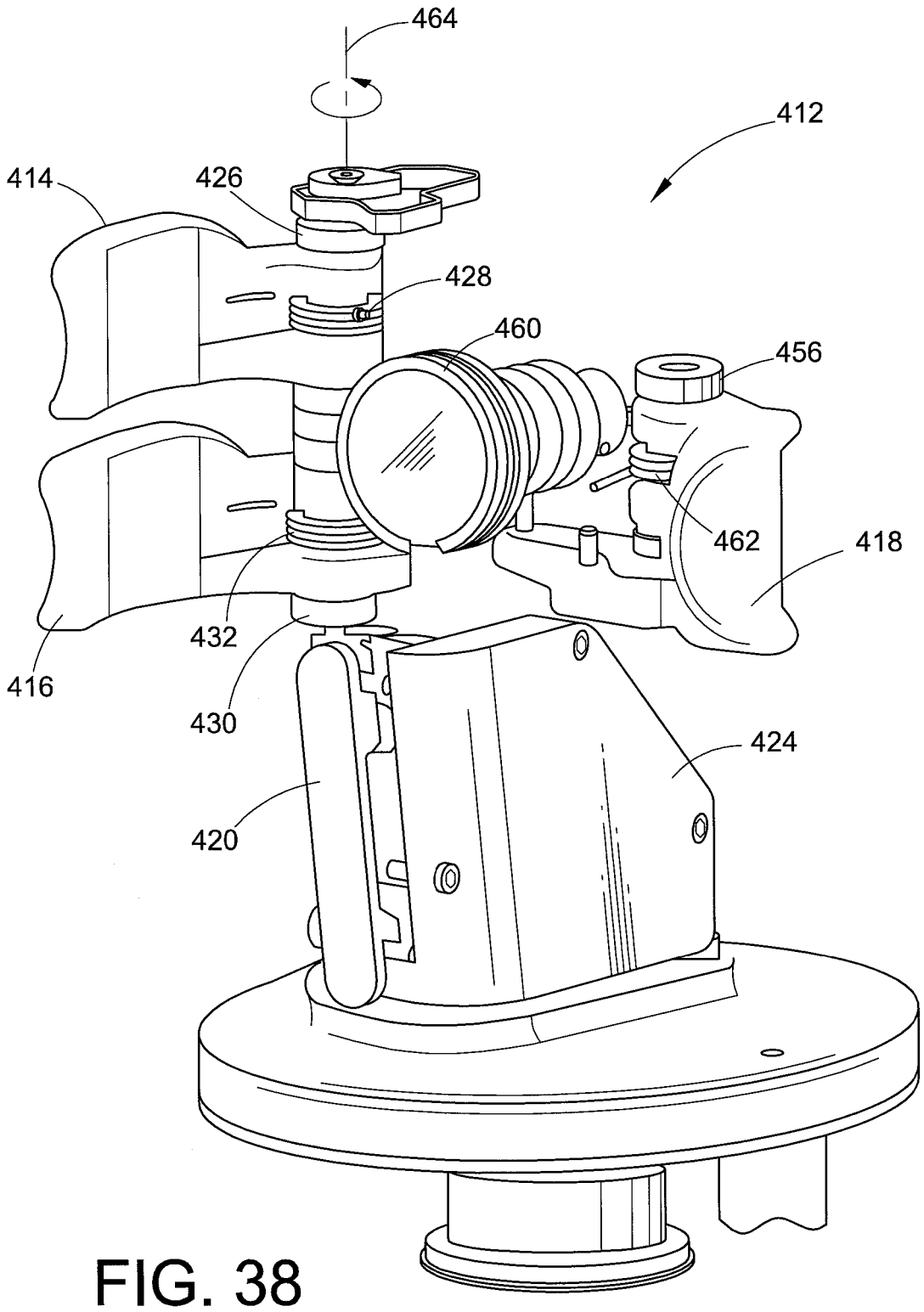
FIG. 38 is an enlarged rear perspective view of the digit angle stage of the joystick apparatus of FIG. 37.

FIG. 33 illustrates the load cell 510 as it is oriented within the central hub 506. The central hub 506 has a hollow cavity in the shape of a tube with four radially spaced slots 540 having radial alignment with the central axis 514. In one embodiment, the load cell 510 includes a T-shaped beam with a plurality of strain gauges positioned along the various surfaces thereon to sense a deflection of the load cell in at least one direction to provide at least one signal or value indicative of a position of the strain gauge assembly 408 relative to the base member 404. In FIGS. 34-36, the load cell 510 includes a first strain gauge 516 positioned along a first side 518 of a vertical beam 546 of the T-shaped beam to sense movement of the actuator assembly 402 relative to the base member 404 in a first direction along the X axis.

The first side 518 (FIG. 35) is positioned to align with a connection point of the first cantilever arm 434 and base plate 452 to the spring plate 500. A second strain gauge 520 is positioned along a second side 522 of the vertical beam 546 of the T-shaped beam to sense movement of the actuator assembly 402 relative to the base member 404 in a second direction along the Y axis. The second side 522 is generally perpendicular relative to the first side 518 although not a strict requirement.

Additionally, strain gauges 524A, 524B are provided along a top surface 542 of a top beam 544 of the T-shaped body to sense movement of the actuator assembly 402 relative to the base member 404 in a third direction along the Z axis. The top beam 544 is generally perpendicular to the vertical beam 546 and aligned within opposing slots 540 of the central hub 506 although not a strict requirement. A fastener base 556 is positioned between strain gauge 524A and strain gauge 524B along the top surface 542 such that the intersection 512 of the thin spokes 504 of the spring plate 500 is configured to be attached thereto. The values or signals provided by these strain gauges can be processed by an associated (internal or external) processor which translates this information into command signals that are used to control the robotic mechanism and robotic arm-hand assembly.

The vertical beam 546 of the load cell 510 includes a first elongated slot 548 that is configured to localize deformation in the first direction at the first strain gauge 516 and a second elongated slot 550 that is configured to localize deformation in the second direction at the second strain gauge 520. The first elongated slot 548 has a shorter length and larger width than the second elongated slot 550 and is vertically spaced therefrom. The top beam 544 includes a horizontal elongated slot 552 that is configured to localize deformation in the third direction adjacent strain gauges 524A and 524B. The load cell 510 includes a base 554 that is configured to fasten to the base platform 505 of the base member 404. A wiring cable 558 and connector 560 are electrically attached to the load cell 510 to communicate the values or signals identified by the strain gauges to a desired processing system.

This orientation provides support to the entire structure while allowing a small amount of flexure that is measurable by the load cell 510 of the strain gauge assembly 408. This small amount of flexure is intended such that the operator perceives some movement of the apparatus similar to tactile feedback while providing a measurable amount of deflection at the load cell 510 that can be identified by the plurality of strain gauges located thereon. Movement of the actuator assembly 402 imposes a bias force on the spring plate 500 such that the thin spokes 504 deform the load cell 510 relative to the base member 404 while the thick arms 508 allow for a minor amount of flexure but primarily provide structural support of the actuator assembly 402 on the central hub 506, ground spring plate 528 and base member 404. This orientation allows the forces from the operator to be transferred directly to the load cell 510 in an accurate and desirable manner that provides simplified use of the controller apparatus.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, processor-executed software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising".

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An apparatus for controlling a machine, comprising:

a base structure including a strain gauge assembly movable in three orthogonal directions to provide at least one signal or value indicative of a position of the strain gauge assembly relative to the base structure; and an actuator assembly supported on the base structure movable by at least one of an associated operator's arm, hand, digit, and wrist relative to the base structure, the actuator assembly operative to provide at least one signal or value indicative of the position of at least one of the operator's arm, hand digit, and wrist relative to the base structure, the actuator assembly comprising:

a wrist angle stage that is moveable about at least one of three orthogonal directions relative to the base structure by operator hand, forearm, or wrist motion, the wrist angle stage providing at least one signal or value indicative of the pivotal position of the wrist angle stage relative to the base member with respect to rotation about at least one of the three orthogonal directions, and a digit angle stage comprising at least one digit actuator movable by operator hand motion relative to the wrist angle stage, the digit angle stage providing at least one signal or value indicative of the position of the at least one digit actuator relative to the wrist stage with respect to at least one of a finger flexion, a thumb flexion, and a thumb rotation of the operator's hand;

wherein the strain gauge assembly includes a spring plate that connects a load cell to the actuator assembly, wherein the load cell includes a T-beam with at least one strain gauge positioned along at least one surface of the T-beam configured to sense a deflection of the load cell and to provide at least one signal or value indicative of the position of the strain gauge assembly relative to the base structure.

2. The apparatus of claim 1 wherein the load cell includes at least three strain gauges configured to sense movement of the actuator assembly relative to the base member in a first direction, a second direction and a third direction.

3. The apparatus of claim 1 wherein the actuator assembly is attached to the spring plate by a cantilever arm.

4. The apparatus of claim 3 wherein the spring plate includes an outer frame that defines a perimeter of the spring plate, the cantilever arm of the actuator assembly is attached to the outer frame of the spring plate.

5. The apparatus of claim 1 wherein the load cell of the strain gauge assembly is positioned within a central hub of the base member, the central hub is attached to the base member.

6. The apparatus of claim 5 wherein the spring plate includes a plurality of arms that extend from the outer frame and attach to the central hub and a plurality of spokes thinner than the plurality of arms, the spokes extending from the outer frame and attach to the load cell.

7. The apparatus of claim 6 wherein the spring plate includes four arms and four spokes that intersect at the central axis of the spring plate, and wherein the load cell is attached to the intersection of the spokes at the central axis.

8. The apparatus of claim 6 wherein movement of the actuator assembly imposes a bias force on the spring plate such that the spokes deform the load cell relative to the base member.

9. The apparatus of claim 8 wherein the spring plate is generally circular such that the central hub is aligned along the central axis of the outer frame such that the plurality of arms radially extend between the central hub and the outer frame.

10. The apparatus of claim 1 wherein the T-beam includes a top member and a vertical member, the top member is generally perpendicular to the vertical member, the vertical member includes a first strain gauge positioned along a first side to sense deflection along a first direction and a second strain gauge positioned along a second side to sense deflection along a second direction, the top member includes a third strain gauge positioned along a top surface to sense deflection along a third direction.

11. The apparatus of claim 10 wherein the spring plate is attached to the top surface of the T-beam of the load cell.

12. The apparatus of claim 10 wherein the vertical member of the T-beam includes a first elongated slot to localize deformation in the first direction at the first strain gauge and a second elongated slot to localize deformation in the second direction at the second strain gauge, the first elongated slot is spaced from the second elongated slot.

13. The apparatus of claim 10 wherein the top member of the T-beam includes a horizontal elongated slot to localize deformation in the third direction at the third strain gauge.

14. An apparatus for controlling a machine, comprising:

a base structure including a strain gauge assembly movable in three orthogonal directions, the strain gauge assembly includes a spring plate attached to a load cell wherein the load cell includes a plurality of strain gauges configured to sense a deflection of the load cell and to provide at least one signal or value indicative of a position of the strain gauge assembly relative to the base structure; and the actuator assembly attached to the spring plate that is movable by at least one of an associated operator's arm, hand, digit, and wrist relative to the base structure, the actuator assembly operative to provide at least one signal or value indicative of the position of at least one of the operator's arm, hand, digit and wrist in at least six degrees of freedom relative to the base structure, the actuator assembly comprising a wrist angle stage and a digit angle stage, the digital angle stage comprising at least one digit actuator movable by operator hand motion relative to the wrist angle stage, the digit angle stage providing at least one signal or value indicative of the position of the at least one digit actuator relative to the wrist stage with respect to at least one of a finger flexion, a thumb flexion, and a thumb rotation of the operator's hand.

15. The apparatus of claim 14 wherein the load cell includes a T-beam with the strain gauges positioned along at least one surface of the T-shaped body to sense a deflection of the T-beam in a first direction, a second direction and a third direction to provide at least one signal or value indicative of a position of the strain gauge assembly relative to the base structure in the first direction, the second direction and the third direction, the T-beam includes a top member and a vertical member, the top member is generally perpendicular to the vertical member, the vertical member includes a first strain gauge positioned along a first side to sense deflection along the first direction and a second strain gauge positioned along a second side to sense deflection along the second direction, the top member includes a third strain gauge positioned along a top surface to sense deflection along the third direction.

16. The apparatus of claim 15 wherein the spring plate is attached to the top surface of the T-beam of the load cell.

17. The apparatus of claim 15 wherein the vertical member of the T-beam includes a first elongated slot to localize deformation in the first direction at the first strain gauge and a second elongated slot to localize deformation in the second direction at the second strain gauge and the top member of the T-beam includes a horizontal elongated slot to localize deformation in the third direction at the third strain gauge.

18. The apparatus of claim 14 wherein the load cell includes a T-beam, where at least one of the strain gauges is positioned along at least one surface of the T-beam to sense a deflection of the T-beam in at least one direction to provide at least one signal or value indicative of a position of the strain gauge assembly relative to the base structure.

19. An apparatus for controlling a machine, comprising:

a base structure attached to a strain gauge assembly movable in three orthogonal directions, the strain gauge assembly includes a spring plate attached to a load cell wherein the load cell includes a plurality of strain gauges configured to sense a deflection of the load cell and to provide at least one signal or value indicative of a position of the strain gauge assembly relative to the base structure; and the actuator assembly attached to the spring plate and positioned over and above the base structure, the actuator assembly is movable by at least one of an associated operator's arm, hand, digit, and wrist relative to the base structure, the actuator assembly operative to provide at least one signal or value indicative of the position of at least one of the operator's arm, hand, digit and wrist in at least six degrees of freedom relative to the base structure.

20. The apparatus of claim 19 wherein the load cell includes a T-beam, where at least one of the strain gauges is positioned along at least one surface of the T-beam to sense a deflection of the T-beam in at least one direction to provide at least one signal or value indicative of a position of the strain gauge assembly relative to the base structure.

* * * * *